US006332501B1

(12) United States Patent
Gipson

(10) Patent No.: US 6,332,501 B1
(45) Date of Patent: Dec. 25, 2001

(54) LINEAR COILED TUBING INJECTOR

(75) Inventor: Thomas C. Gipson, Cisco, TX (US)

(73) Assignee: Precision Drilling Corporation, Calgary (CA)

( * ) Notice: Subject to any disclaimer, the term of this patent is extended or adjusted under 35 U.S.C. 154(b) by 0 days.

(21) Appl. No.: 09/569,965

(22) Filed: May 12, 2000

(30) Foreign Application Priority Data

Feb. 3, 2000 (CA) ..... 2298098

(51) Int. Cl.[7] ..... E21B 19/22
(52) U.S. Cl. ..... 166/384; 166/77.3; 226/173
(58) Field of Search ..... 166/77.1, 77.2, 166/77.3, 384, 385; 175/173; 226/170, 171, 173

(56) References Cited

U.S. PATENT DOCUMENTS

| | | | | |
|---|---|---|---|---|
| 2,567,009 | | 9/1951 | Calhoun et al. . | |
| 3,313,346 | | 4/1967 | Cross . | |
| 3,363,880 | | 1/1968 | Blagg . | |
| 3,373,818 | | 3/1968 | Rike et al. . | |
| 3,379,052 | | 4/1968 | Howard et al. | 73/81 |
| 3,559,905 | | 2/1971 | Palynchuk . | |
| 4,585,061 | * | 4/1986 | Lyons, Jr. et al. | 166/77.3 |
| 4,673,035 | | 6/1987 | Gipson . | |
| 5,188,174 | * | 2/1993 | Anderson, Jr. et al. | 166/77.3 |
| 5,215,151 | | 6/1993 | Smith et al. | 175/45 |
| 5,279,364 | | 1/1994 | Jantzen et al. . | |
| 5,309,990 | | 5/1994 | Lance . | |
| 5,553,668 | | 9/1996 | Council et al. | 166/77.3 |
| 5,566,764 | * | 10/1996 | Elliston | 166/385 |
| 5,839,514 | | 11/1998 | Gipson | 166/384 |
| 5,842,530 | | 12/1998 | Smith et al. | 175/162 |
| 5,890,534 | | 4/1999 | Burge et al. | 166/77.3 |
| 5,918,671 | | 7/1999 | Bridges et al. | 166/77.3 |
| 5,975,203 | | 11/1999 | Payne et al. | 166/77.3 |
| 6,173,769 | * | 1/2001 | Goode | 166/77.3 |
| 6,189,609 | * | 2/2001 | Shaaban et al. | 166/77.3 |

* cited by examiner

*Primary Examiner*—George Suchfield
(74) *Attorney, Agent, or Firm*—Sheridan Ross P.C.

(57) ABSTRACT

An injector is provided for injecting and withdrawing large diameter coiled tubing comprising a linear section of gripping blocks driven on an endless chain conveyor. The coiled tubing is forced into frictional engagement with the blocks by a corresponding linear array of rollers. The arrangement is gentle on the coiled tubing. The injector is not restricted in length and thus provides a linear driving section of configurable length for providing superior injection and pulling capacities. In combination with the strong draw works, the mast and rotary table of a conventional rig enables making up both sectional tubing for assembling BHA's, drilling surface hole and making up to non-rotating coiled tubing from the injector. Using a mast having two open sides and with dual draw works, increased functionality is provided and less serial handling.

26 Claims, 37 Drawing Sheets

LINEAR COILED TUBING INJECTOR

FIELD OF THE INVENTION

The invention relates to coiled tubing injectors, and apparatus and methods for combining conventional sectional tubing drilling with drilling using coiled tubing. More particularly, a collapsible mast and rotary table can be arranged for operation with both a catwalk for sectional tubulars and with a coiled tubing unit. A linear coiled tubing injector is sufficiently narrow to coexist in the mast while tripping conventional tubulars.

BACKGROUND OF THE INVENTION

The general background relating to coiled tubing injector units is described in U.S. Pat. Nos. 5,83 9,514 and 4,673,035 to Gipson which are incorporated herein by reference for all purposes.

Apparatus for conventional drilling with sectional tubing is very well known.

Coiled tubing has been a useful apparatus in oil field operations due to the speed at which a tool can be run in (injected) and tripped out (withdrawn) from a well bore. Coiled tubing is supplied on a spool. An injector at the wellhead is used to grip and control the tubing for controlled injection and withdrawal at the well. As coil tubing cannot be rotated, drilling with coiled tubing is accomplished with downhole motors driven by fluid pumped downhole from the surface.

SUMMARY OF THE INVENTION

Linear Injector

In one aspect the linear injector of the present invention extends coiled tubing capability beyond that known heretofore. In combination with a conventional jointed drilling rig, none of the functionality of the conventional rig is sacrificed while achieving enhanced capabilities by the addition of coiled tubing.

In the preferred embodiment, coiled tubing is driven along a linear section of an endless chain conveyor with an opposing linear array of rollers. Using prior art dual conveyors, gripper blocks pull on both sides of the coiled tubing and the present invention only pulls on one side. Applicant has found that by eliminating the prior art parallel chain drives, the difficulty to synchronize the two drives is avoided and the substitution of non-driving rollers for one side of the tubing injector results in less damage to the coiled tubing. Further, by eliminating the challenge of maintaining dual chain synchronicity, the novel injector is able to take unrestricted advantage of an extended length of a linear driving section, thus providing superior injection and pulling capability.

Accordingly, in one preferred aspect of the invention, deep wells can be drilled with coiled tubing even from the surface due to the combination of enabling the use of full diameter tubing, implementing a straightener and using an injector which is capable of applying both significant injector force on a drilling bit and full pulling capability f or tripping out of the deep wells. An injector of 20 feet in length is capable of a nominal pulling capacity of about 100,000 lb. force. Further, suspension of the preferred injector in a conventional derrick having strong draw works and a rotary table permits operation with both conventional sectional tubing, including BHA, and simplifying the making up to coiled tubing.

In a broad aspect of the invention then, coiled tubing injection apparatus is provided comprising:

a chain conveyor extending about an endless path and having at least one linear section aligned with the wellbore;

a multiplicity of gripper blocks conveyed and driven by the chain conveyor, the gripper blocks forming a substantially continuous coiled tubing support while traversing the linear portion;

a linear array of a multiplicity of rollers in parallel and opposing arrangement to the linear section of the chain conveyor for forming a corridor therebetween and through which the coiled tubing extends, the rollers urging the coiled tubing into frictional engagement with the gripper blocks;

means for supporting the gripper blocks against the normal forces produced by the linear array of rollers; and means for driving the chain conveyor along the endless path so as to drive the gripper blocks which frictionally drive the coiled tubing along the corridor.

Preferably idlers extend laterally from the gripper blocks for rolling along a track, thereby supporting the normal forces on the chain conveyor. More preferably, biasing means are provided for adjusting the normal force imposed by the rollers against the coiled tubing. Further, a tubing straightener is positioned between the apparatus and a source of coiled tubing, just preceding the corridor between the linear portion of the gripper blocks and the linear array of rollers.

In another embodiment, the linear injector can be pivotally mounted to a mobile transport for aligning the linear injector with wellheads at any angle to the surface.

In another aspect, the present invention utilizes a combination of apparatus which borrows the best of both the conventional and coiled tubing drilling apparatus for providing improved efficiency in drilling operations. Both the conventional and coiled tubing art is improved to permit even deep wells to be drilled using coiled tubing. While conventional coiled tubing injectors could be used, they must be narrow enough to standby in the mast while sectional drilling is ongoing. One such injector is a novel coiled tubing linear injector which further extends coiled tubing capability beyond that known heretofore. When used in combination with a mast capable of handling conventional tubing, none of the functionality of the conventional rig is sacrificed while achieving enhanced capabilities by the addition of coiled tubing. Where it would normally be required to use a very tall mast for making up stands of sectional pipe, a shorter mast can be implemented with coiled tubing. Further, by providing a mast which is accessible on two sides, and having a side-shifting crown assembly with dual block/hooks combinations, then operations with both conventional sectional and coiled tubing is radically simplified and streamlined.

In a preferred embodiment, two rigs are provided. A first rig comprises a collapsible mast on a trailer, a substructure, rotary tubing drive means (table or power swivel), side shifting crown, dual blocks and dual drawworks. An integrated hydraulic system powers the drawworks, side-shifting crown, rotary table and lifts the collapsible mast. A second rig comprises a coiled tubing injector and a reel of coiled tubing on a trailer. Suitable support equipment is provided such as a mud system, mud pump and control house. The two rigs are arranged tail to tail. The mast, when erected, has a first side open to the deck of the trailer of the first rig, forming a catwalk for drill pipe. The opposing side of the mast is open to the second coiled tubing rig. Accordingly, lengths of sectional tubulars can be handled or drawn up the first open side from the first rig; and coiled tubing can be introduced from the second side.

While other injectors of mast-capable installation are anticipated, in the most preferred embodiment, the novel injector meets all the requirements, having a shallow depth and can idle, set aside in the mast, when handling sectional tubulars (tubing or casing). Simply, the preferred injector comprises a linear section of an endless chain conveyor with an opposing linear array of tubing hold-down rollers. As disclosed above, by eliminating the prior art dual and parallel chain drives it is possible to eliminate the known difficulty of synchronizing the two drives and to avoid the bulky machinery of dual chain drives required to hold the dual drives in facing relation. Further, the substitution of non-driving rollers for one side of the tubing injector results in less damage to the coiled tubing. Further, by eliminating the challenge of maintaining dual chain synchronicity, the novel injector is able to take unrestricted advantage of an extended length of a linear driving section, thus providing superior injection and pulling capability and enabling use of conventional diameter tubing.

Accordingly, in one preferred aspect of the invention, deep wells can now be drilled with coiled tubing, even from the surface, due to the implementation of an injector which is capable of applying both significant injector force on a drilling bit and full pulling capability for tripping out of the deep wells, and preferably a straightener and even being able to using conventional diameters of sectional tubulars. It is noted that the novel injector of 15 feet in length is capable of a nominal pulling capacity of about 80,000 lb. force. Further, suspension of the preferred injector in a mast, having both strong draw works and a rotary table, permits operation with both conventional sectional tubing, including assembling of the BHA, and simplifying the making up to coiled tubing. Having both open sides minimizes the footprint of this hybrid drilling apparatus. Further drilling efficiency is improved, eliminating wasted steps formerly required to decommission one type of drilling apparatus and commission the other.

In a broad aspect of the invention then, a method for hybrid drilling of a well with both sectional tubulars and coiled tubing comprises the steps of:

providing a hybrid drilling system having a mast having at least one open side and equipped for drilling with tubulars, at least one drawworks and a drive for rotating tubulars, and having a coiled tubing injector having a supply of coiled tubing;

lifting the injector into the mast using the drawworks;

alternately drilling with tubulars or with coiled tubing; and setting the injector aside in the mast when drilling with tubulars.

Preferably, the method further comprises handling tubulars and coiled tubing through the same open side of the mast. More preferably, the tubulars and are handled through separate open sides of the mast.

In a broad aspect, apparatus for achieving the above method comprises:

a mast over the well having at least one open side;

drawworks and a rotary drive for the handing and drilling of the tubulars through the mast's open side; and a coiled tubing injector and supply of coiled tubing, the injector being sufficiently compact to be hung in the mast from the drawworks with the coiled tubing being supplied through the mast's open side.

Preferably, the apparatus comprises a mast and tubular rotating means, the mast having a side shifting crown having at least two positions over the well and first and second opposing and open sides, a first block/hook fitted to the side shifting crown and being fitted with elevators for handling tubing through the first open side; a second block/hook being fitted to the side shifting crown, the second block hook being alternately fitted with, a swivel for rotary drilling with tubulars, and a coiled tubing injector for drilling with coiled tubing supplied through the second open side; and a coiled tubing injector, preferably one having a bi-directional driven chain fitted with tubing gripper blocks which extend about an endless path and having at least one linear supported section aligned with the wellbore, and a linear array of hold-down rollers in parallel and opposing arrangement to the linear section of the chain conveyor for forming a corridor therebetween and through which coiled tubing extends, the rollers urging the coiled tubing into frictional engagement with the gripper blocks.

BRIEF DESCRIPTION OF THE DRAWINGS

Linear Injector

Single Side Hybrid System

Figure 12:
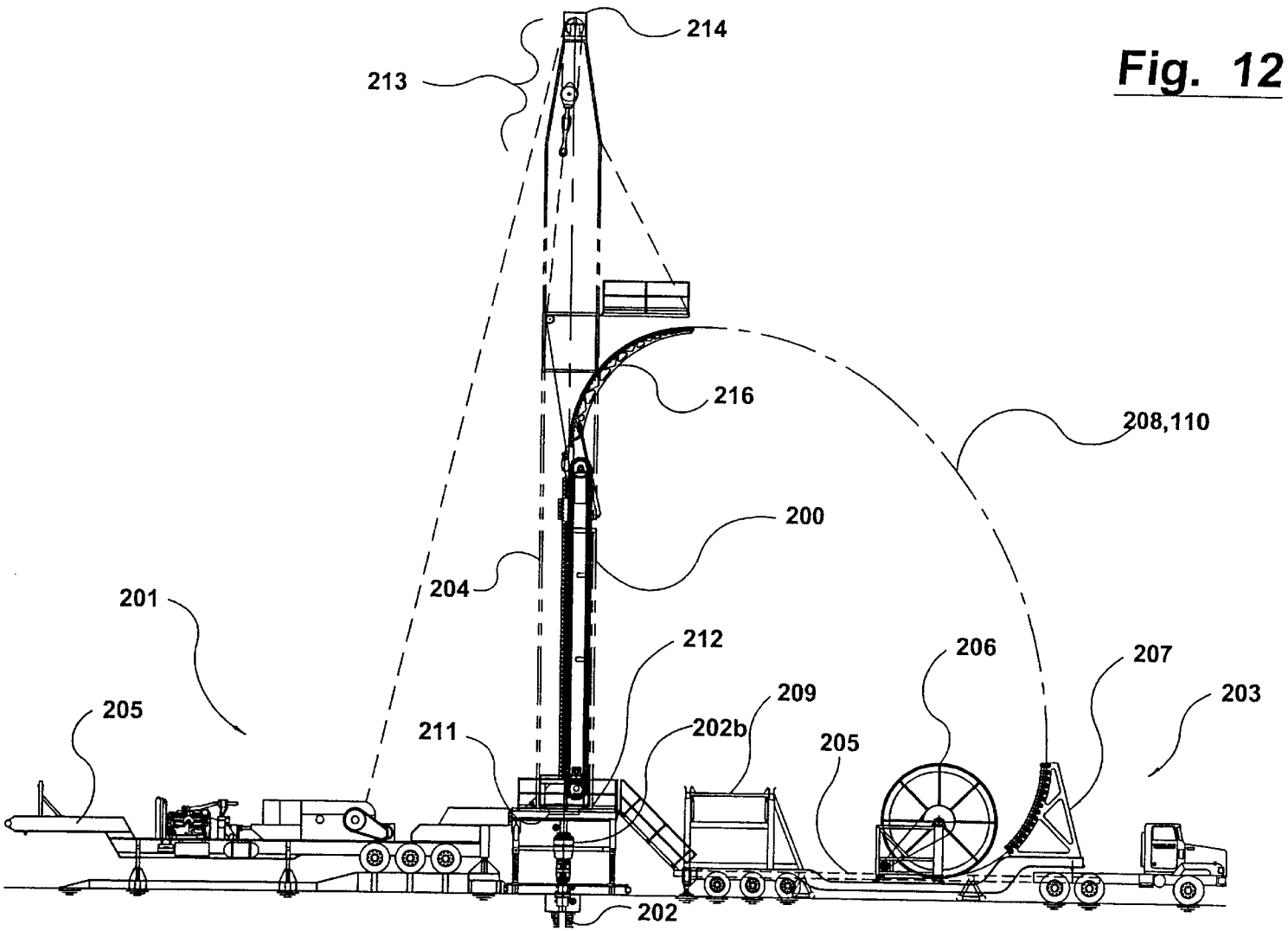
Figure 13:
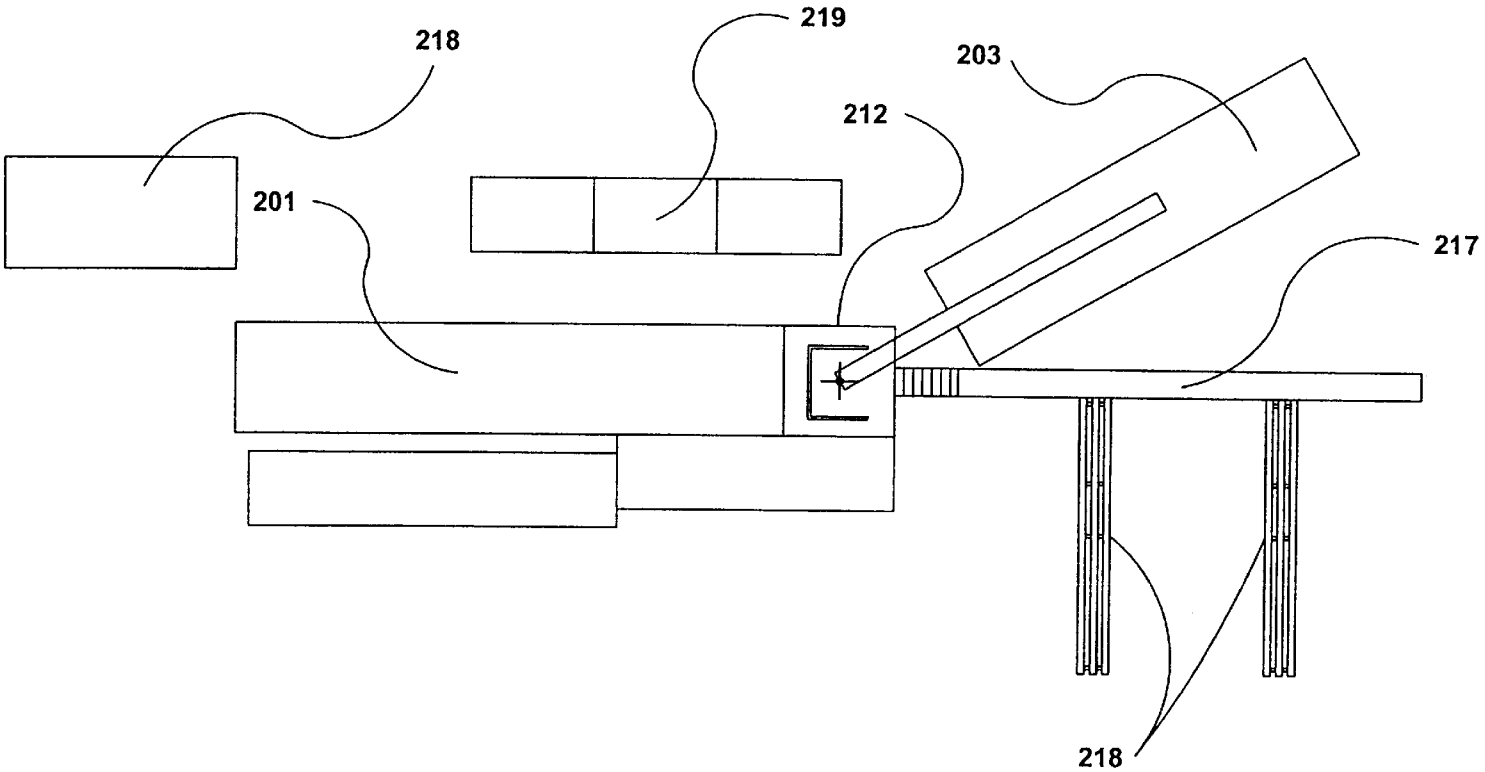
Figure 14:
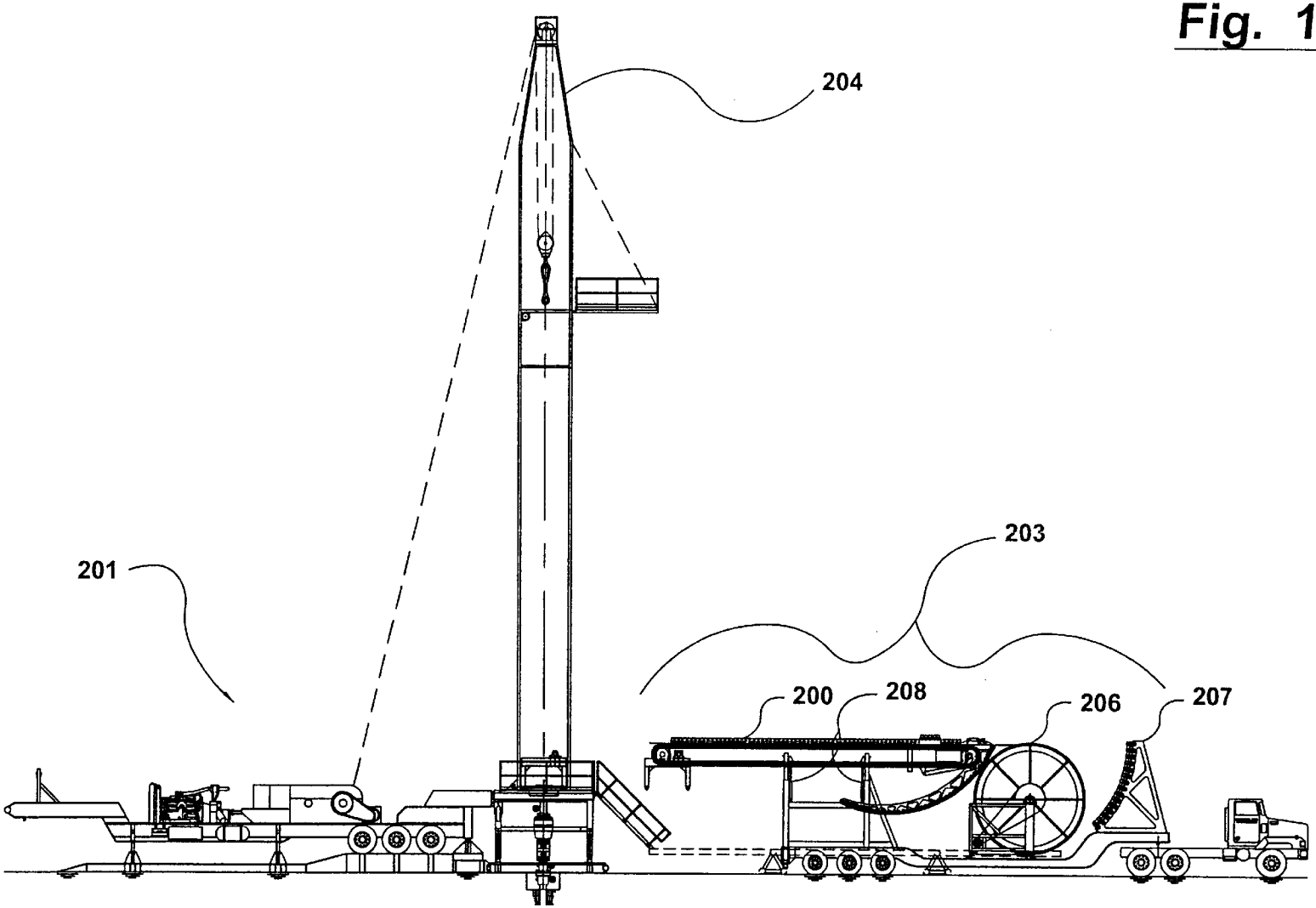
Figure 15:
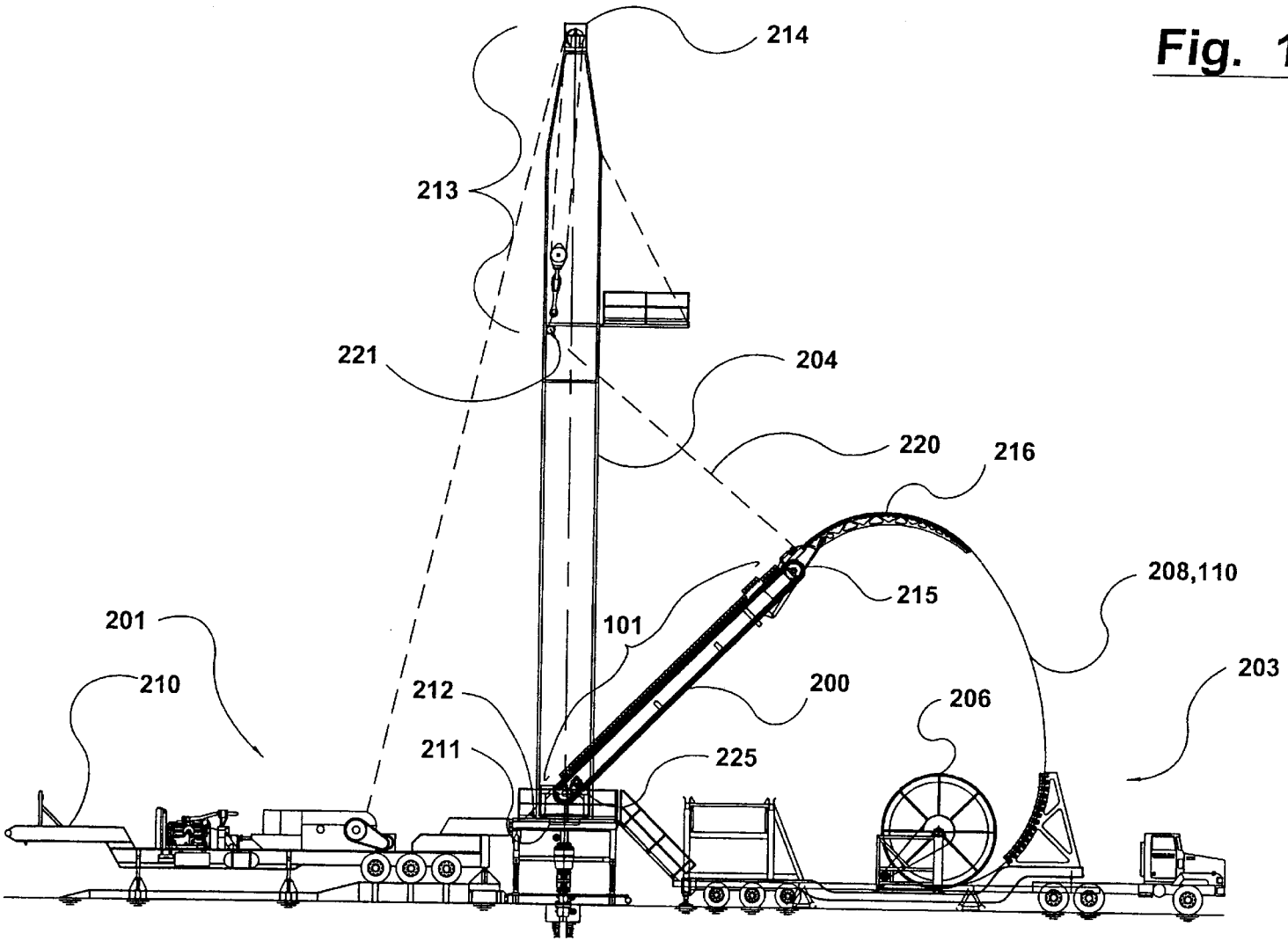
Figure 16:
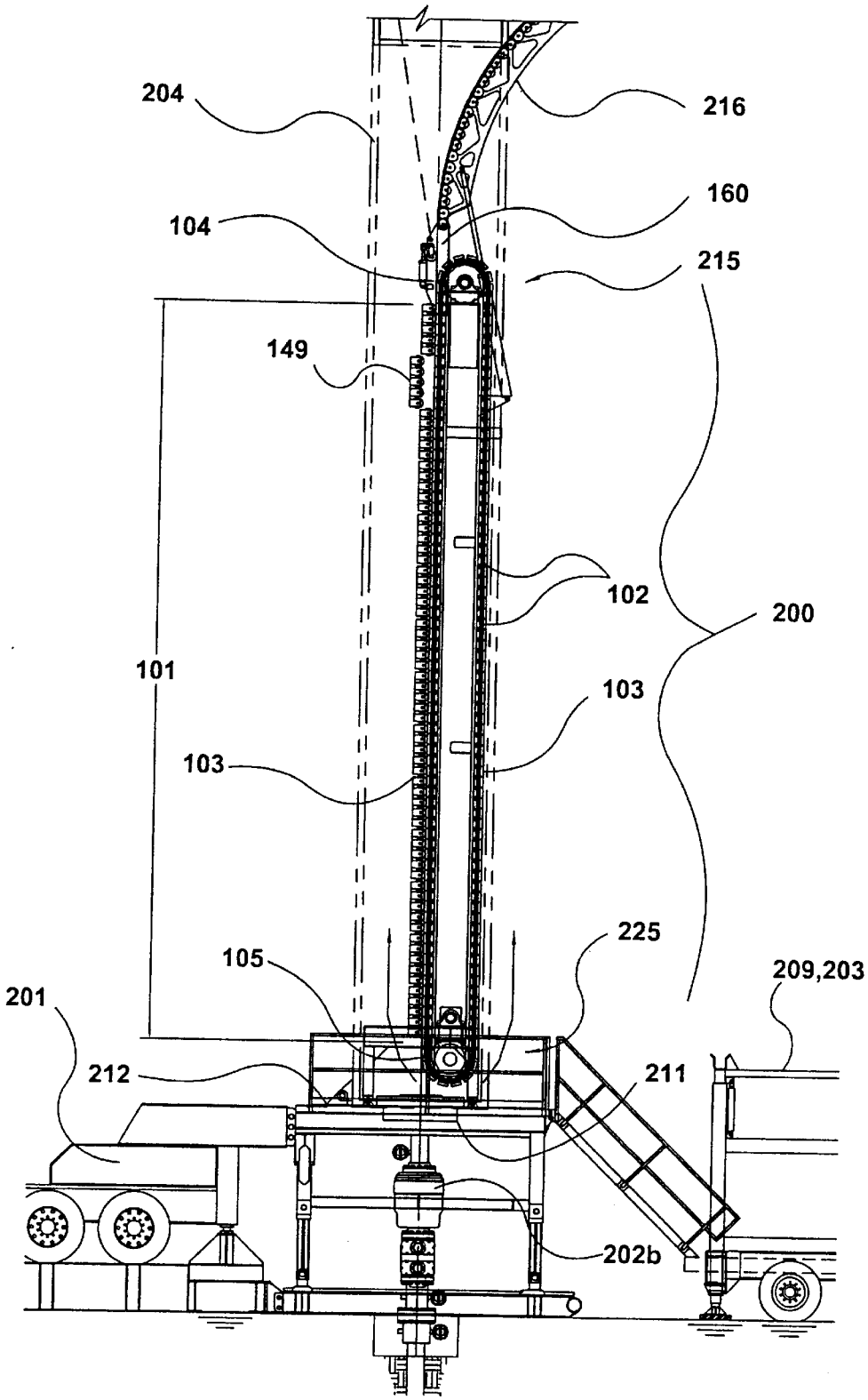
Figure 17:
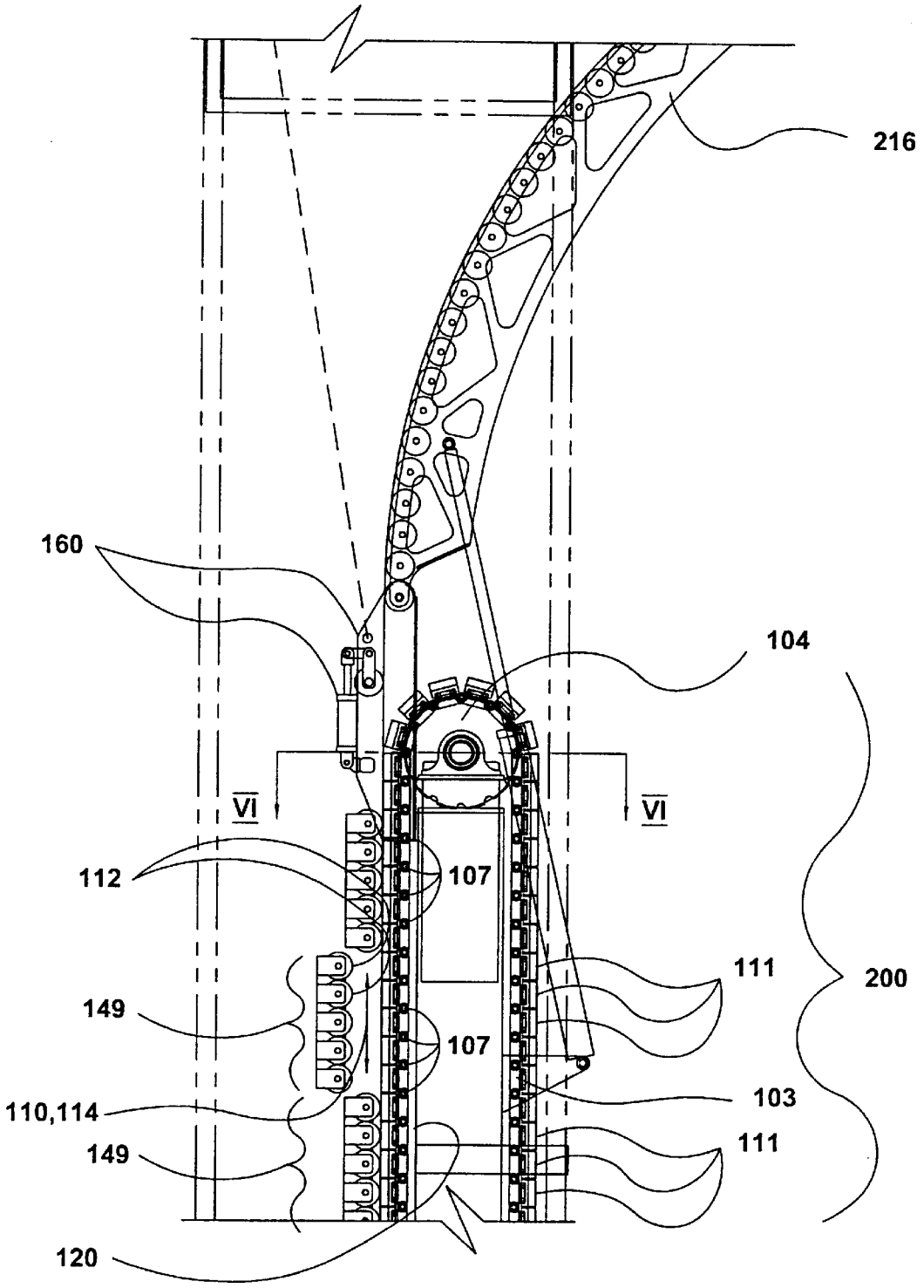
Figure 18:
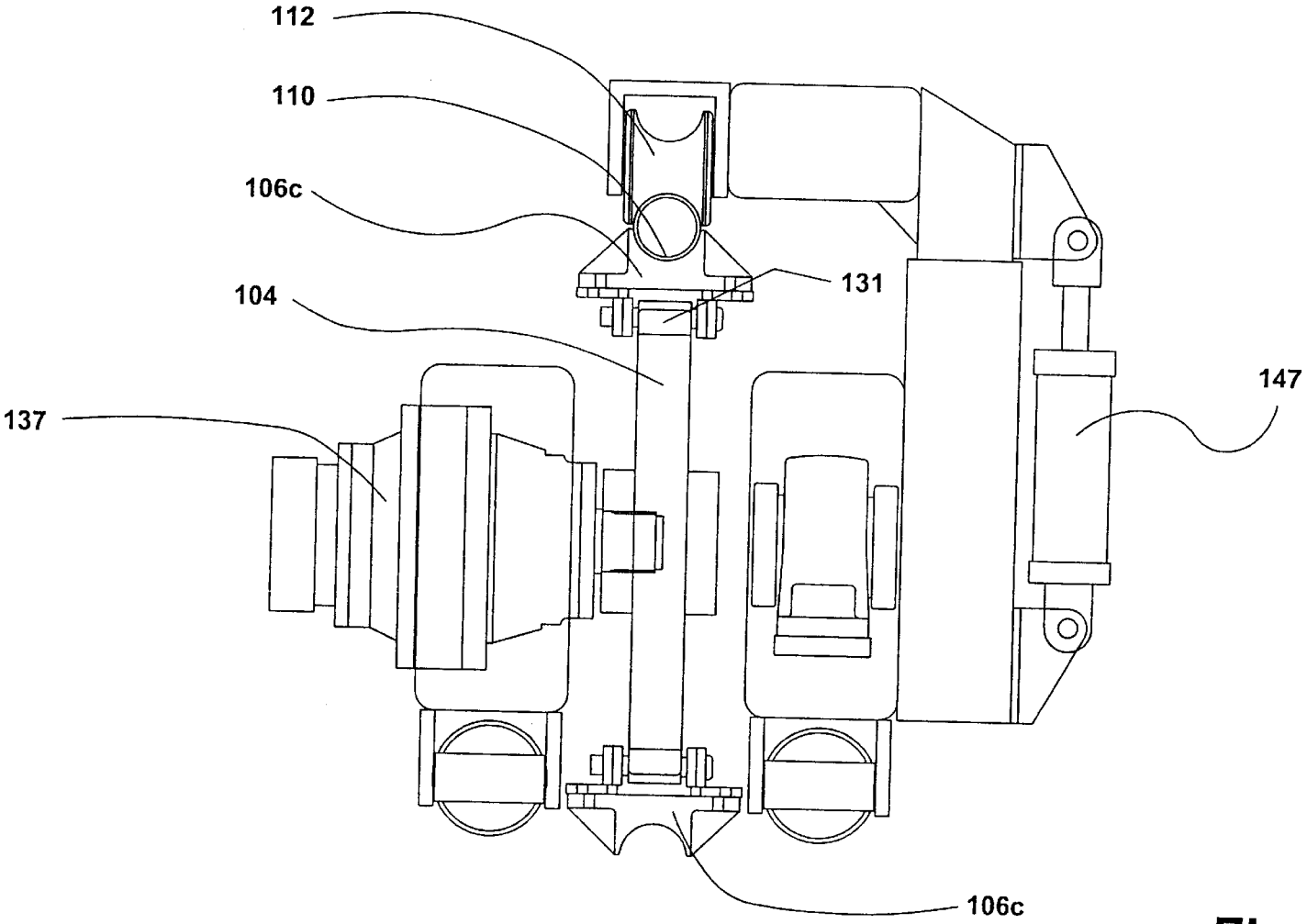
Figure 19A:
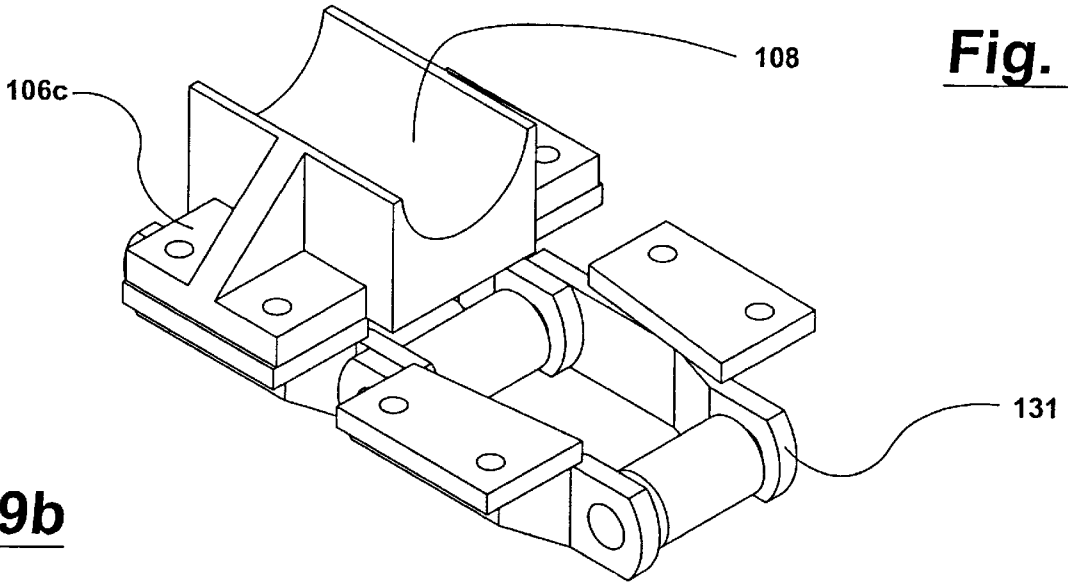
Figure 19B:
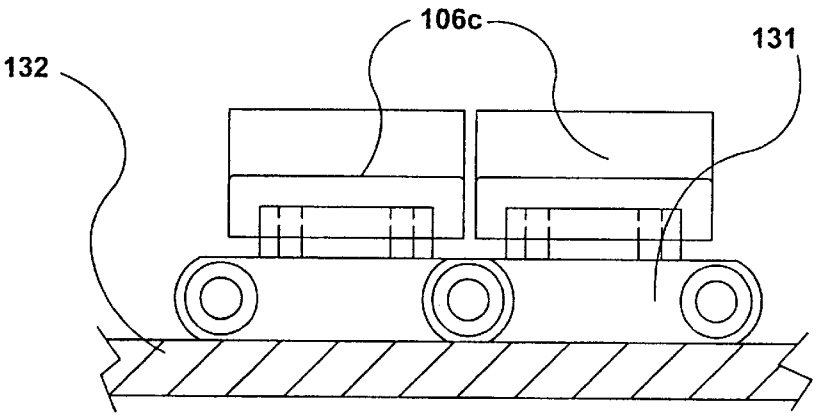
Figure 19C:
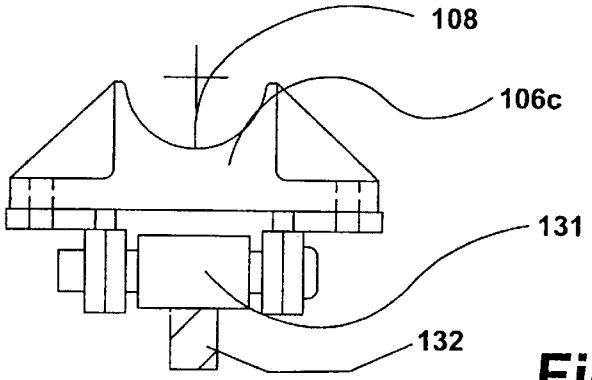
Figure 21:
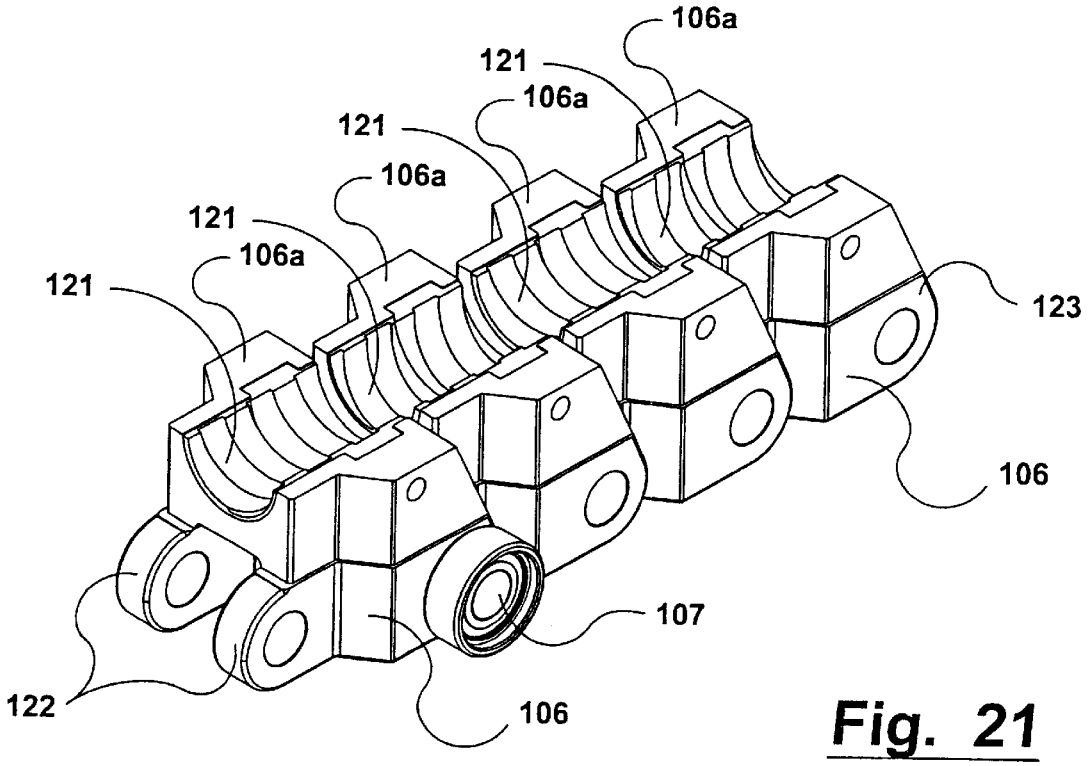
Figure 20:
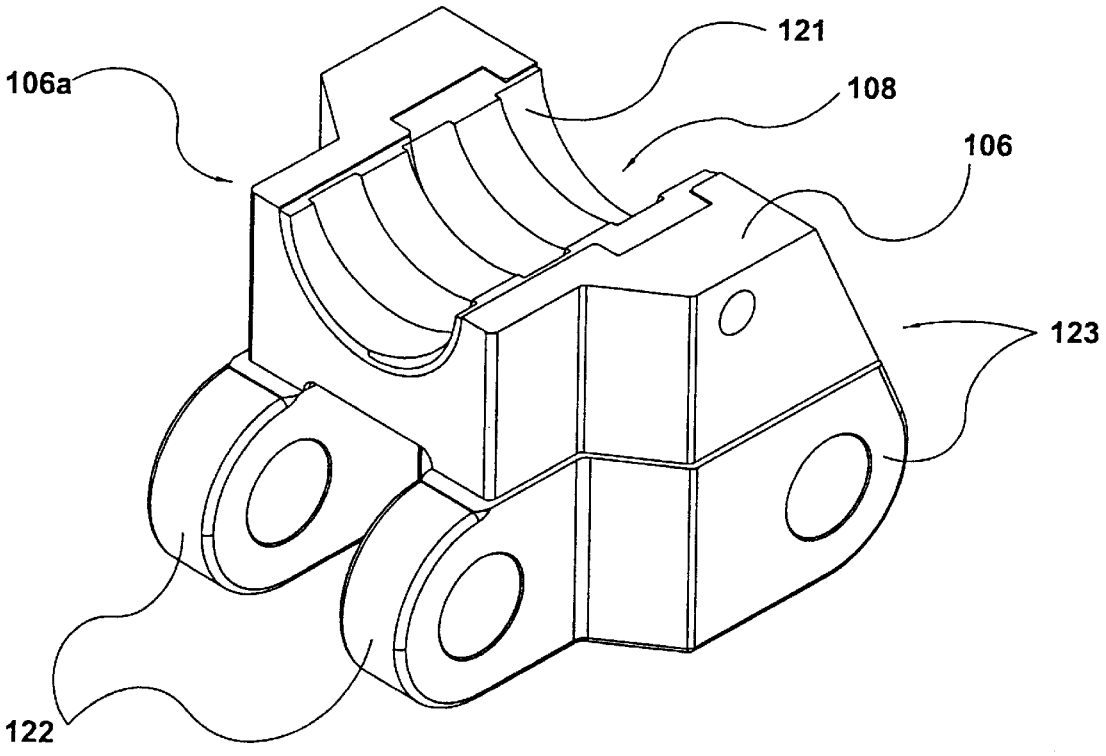
Figure 23:
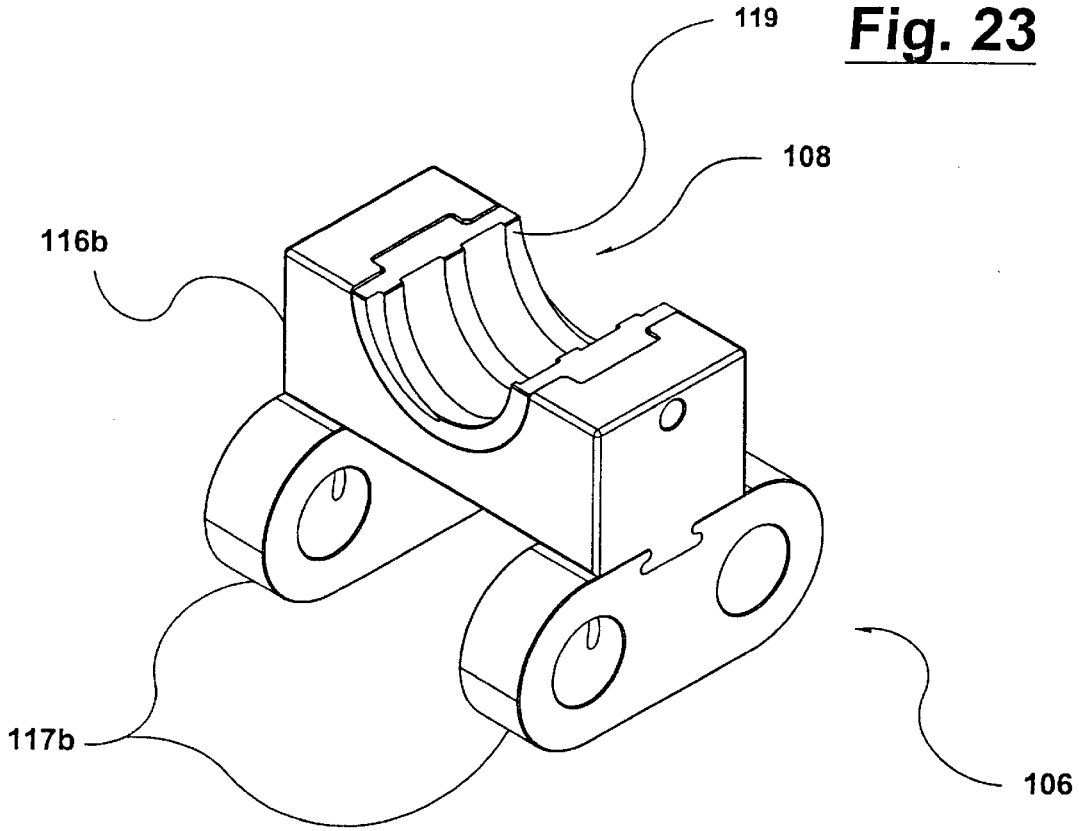
Figure 22:
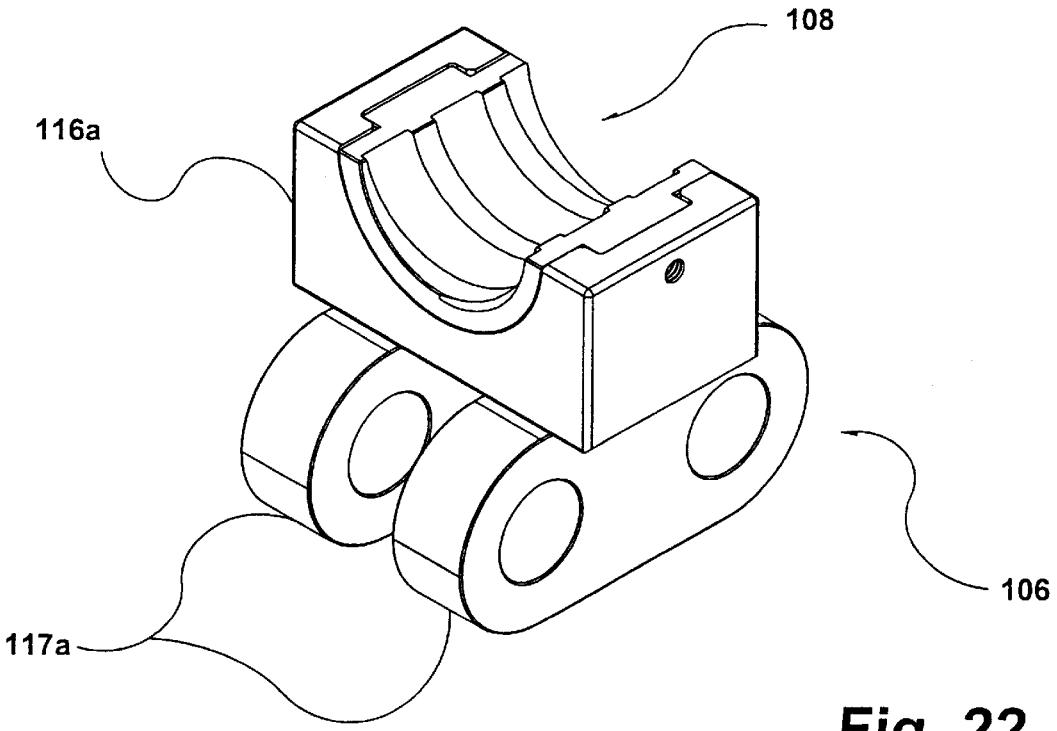
Figure 24:
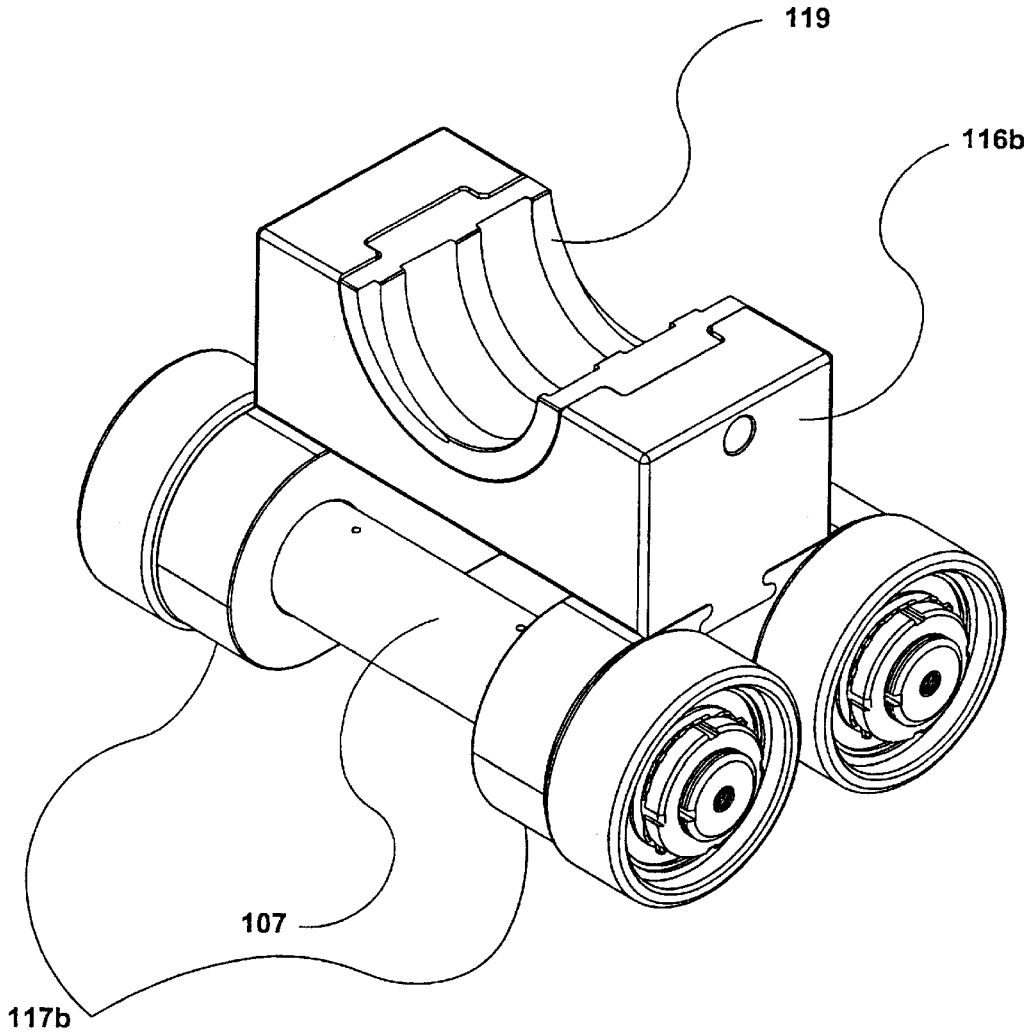
Figure 25:
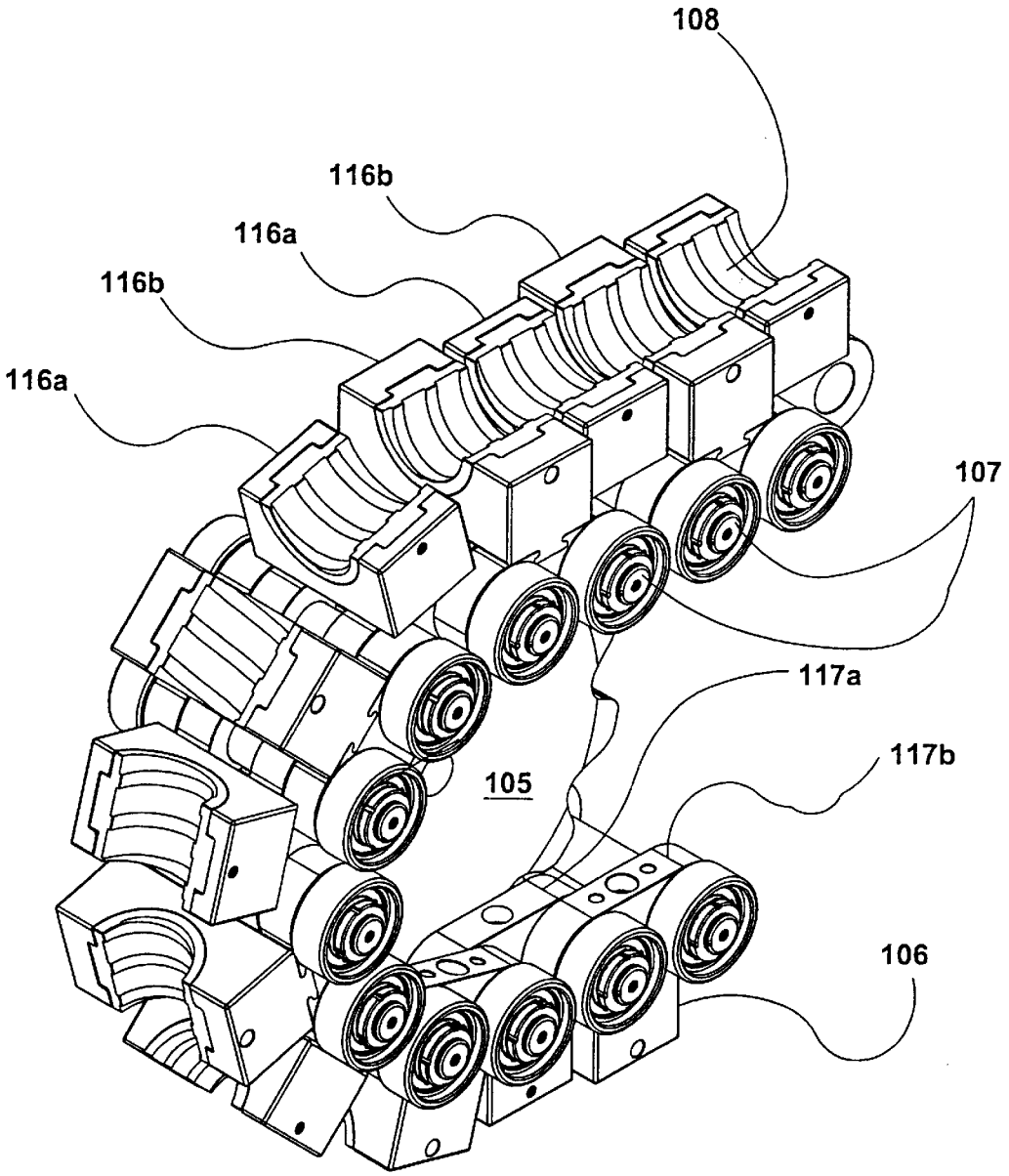
Figure 26:
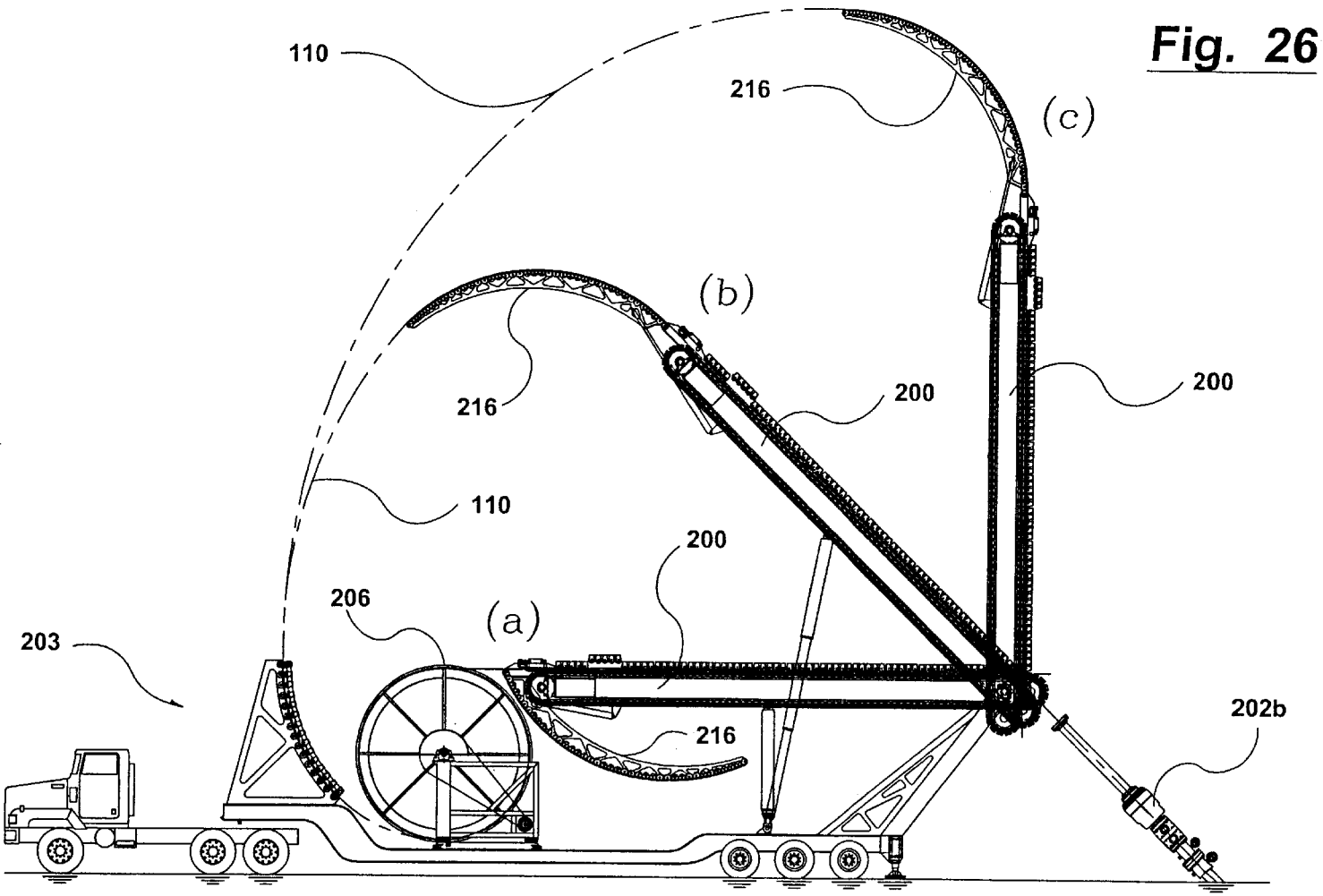

FIG. 12 is a side elevation view of one arrangement of the novel hybrid linear injector in combination with a conventional sectional tubing mast and draw works with sectional and coiled tubing accessing the mast from the same open side;

FIG. 13 is a plan view of the arrangement according to FIG. 12 illustrating a preferred "V" arrangement of the coiled tubing transport rig, catwalk and the conventional mast;

FIG. 14 is a side elevation view of the linear injector arrangement according to FIG. 12, the linear injector being in a shipping position on its coiled tubing trailer;

FIG. 15 is a linear injector arrangement according to FIG. 12, the lower end of the linear injector being pinned in the base of a conventional mast and the upper end being in a partially raised position as it is being lifted by the mast's drawworks;

FIG. 16 is a close up side view of the linear injector of FIG. 12 installed in the conventional mast and aligned over the wellhead;

FIG. 17 is a partial close up of the upper end of the linear injector of FIG. 16 illustrating the straightener and nip of the blocks and the rollers;

FIG. 18 is a plan, cross-sectional view of one embodiment of the head sprocket and drive for illustrating a hydraulic arrangement for loading the coiled tubing holddown rollers;

FIGS. 19*a*–19*c* illustrate isometric, side and end views respectively of one embodiment of the gripper block assembly, wherein conventional roller chain is fitted with brackets and gripper blocks;

FIG. 20 is an isometric view of an alternate embodiment of gripper block, specifically illustrating a single offset roller gripper block;

FIG. 21 is an isometric view of a train of offset roller gripper blocks according to FIG. 20, one of which is shown fitted with a reaction idler;

FIG. 22 is an isometric view of an alternate embodiment of a gripper block, specifically illustrating the narrow block of a matched pair of narrow and wide roller gripper blocks;

FIG. 23 is an isometric view of the wider second block of a matched pair of roller gripper blocks according to FIG. 22;

FIG. 24 is an isometric view of the wider second block of FIG. 23, fitted with idlers;

FIG. 25 is an isometric view of a train of roller gripper blocks according to FIGS. 22 and 23 extending over a sprocket; and FIG. 26 illustrates a side elevation view of an alternate implementation of the novel linear injector, illustrating three stages (a),(b),(c) of an all-in-one coiled tubing rig utilizing the novel injector for workovers or for directional drilling of predominately shallow wells;

Dual Duty Hybrid System

Figure 27:
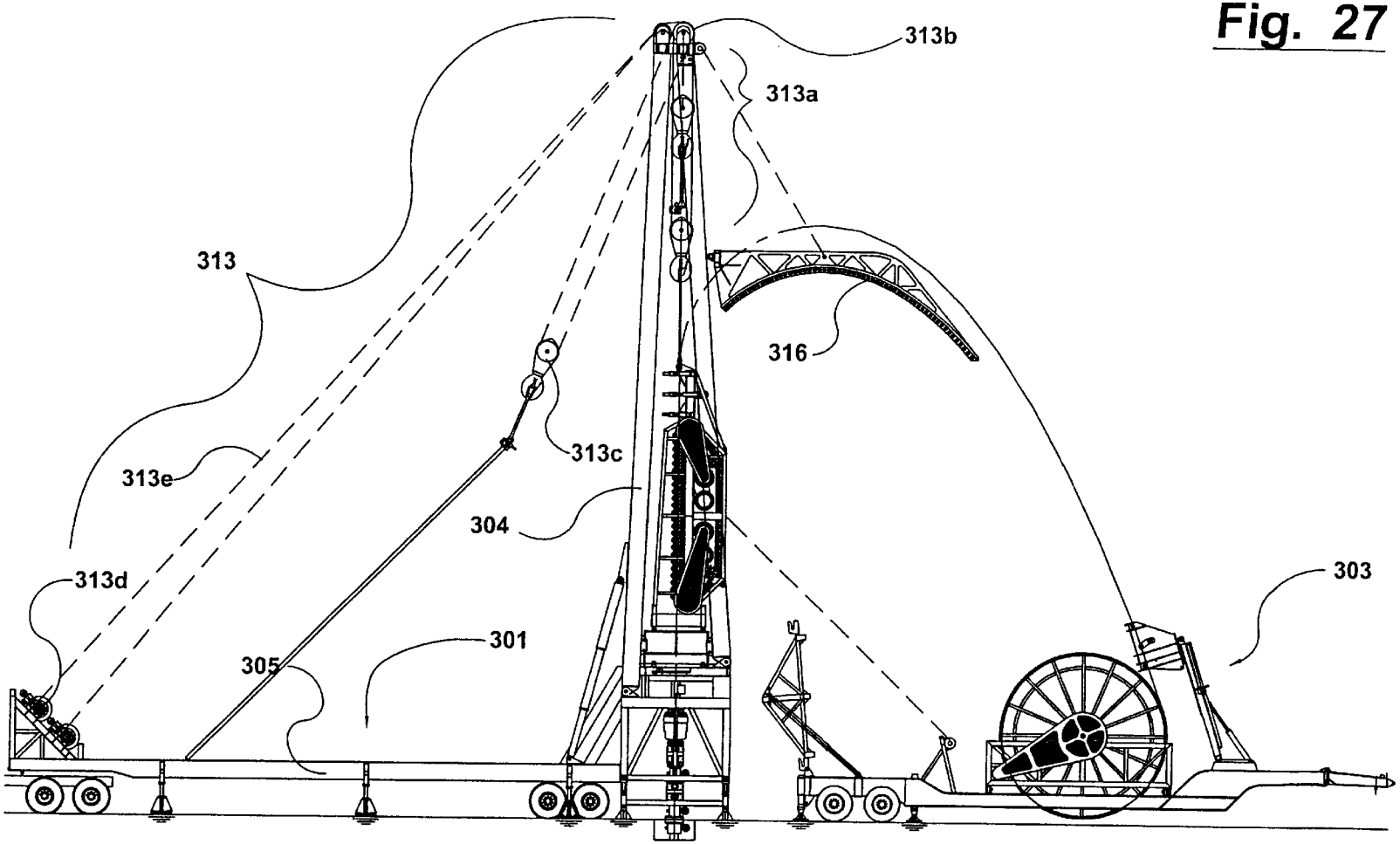
Figure 28:
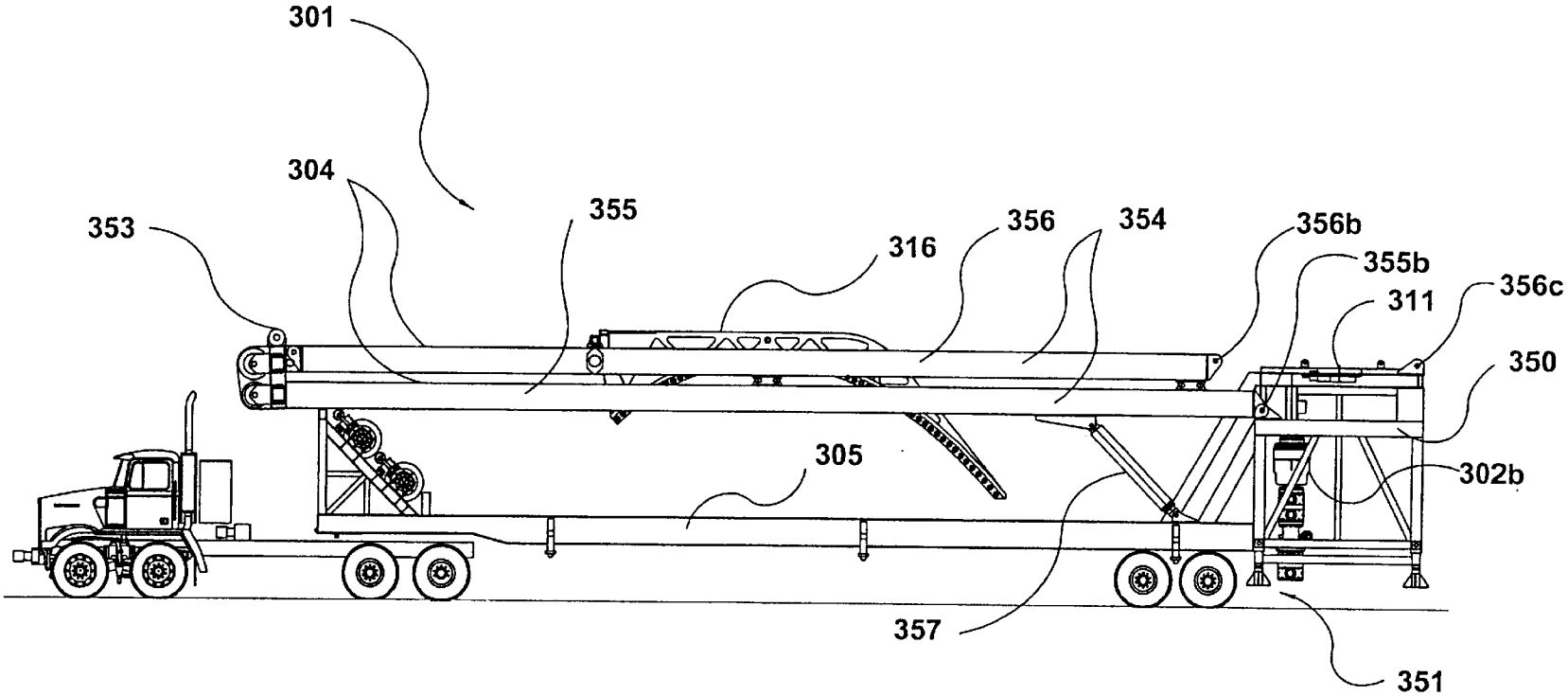
Figure 29:
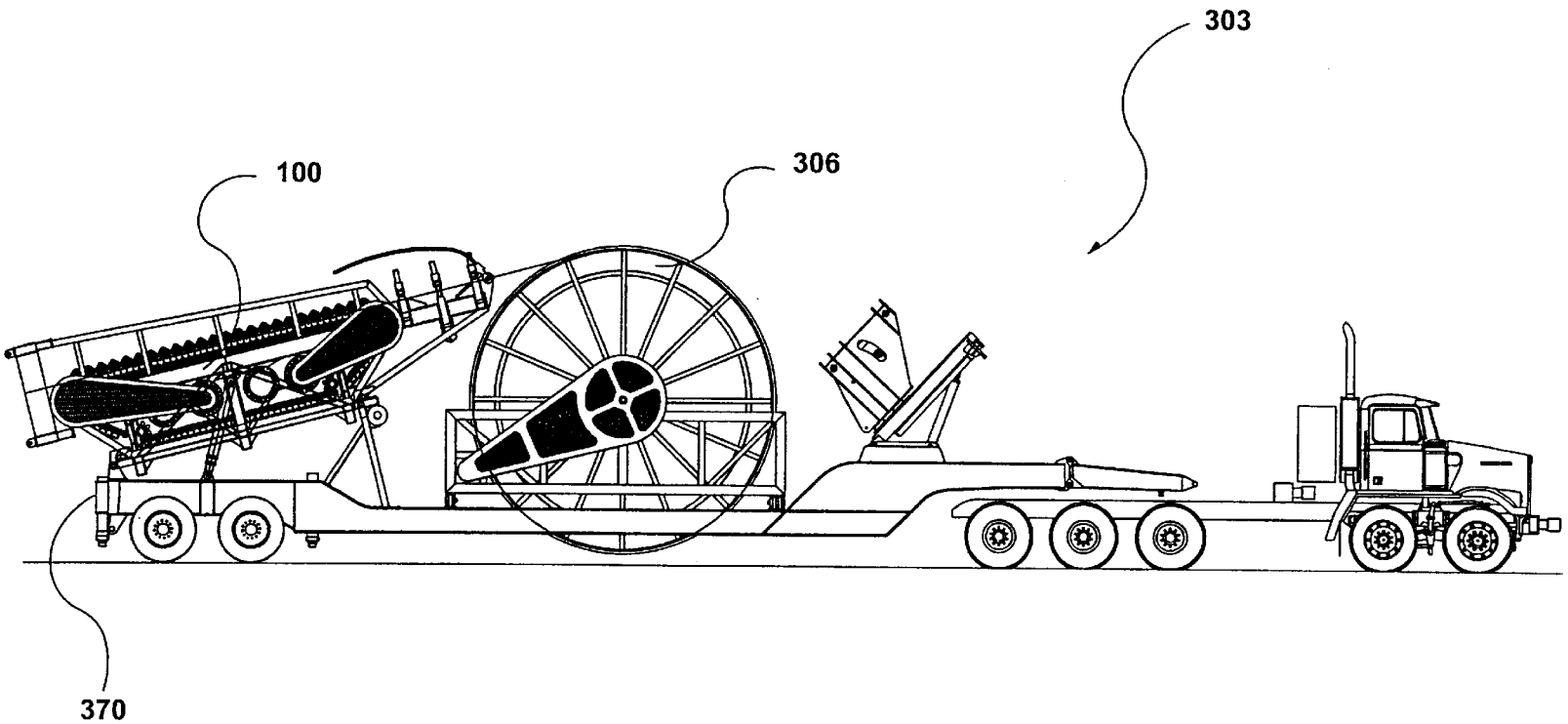
Figure 30A:
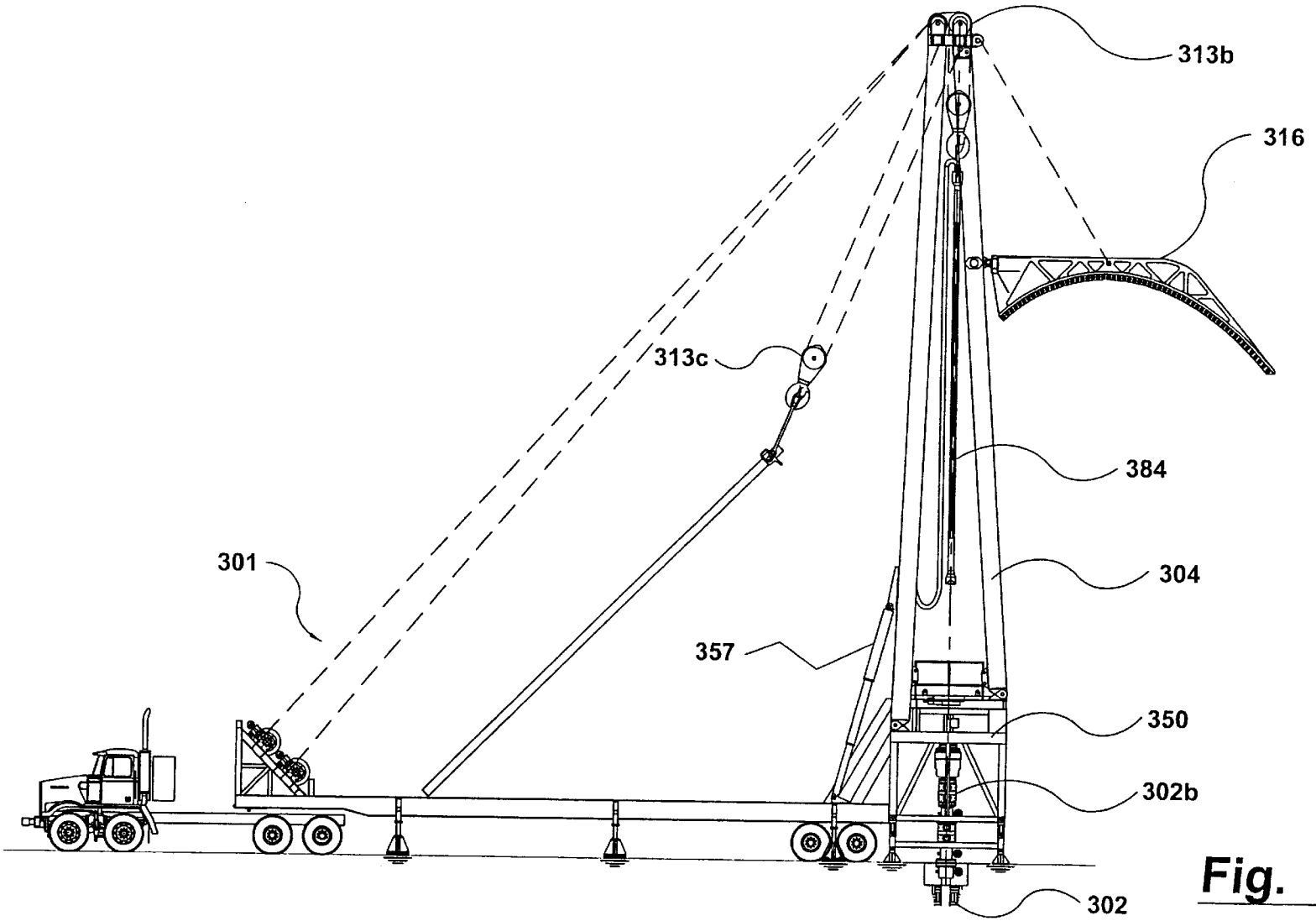
Figure 30B:
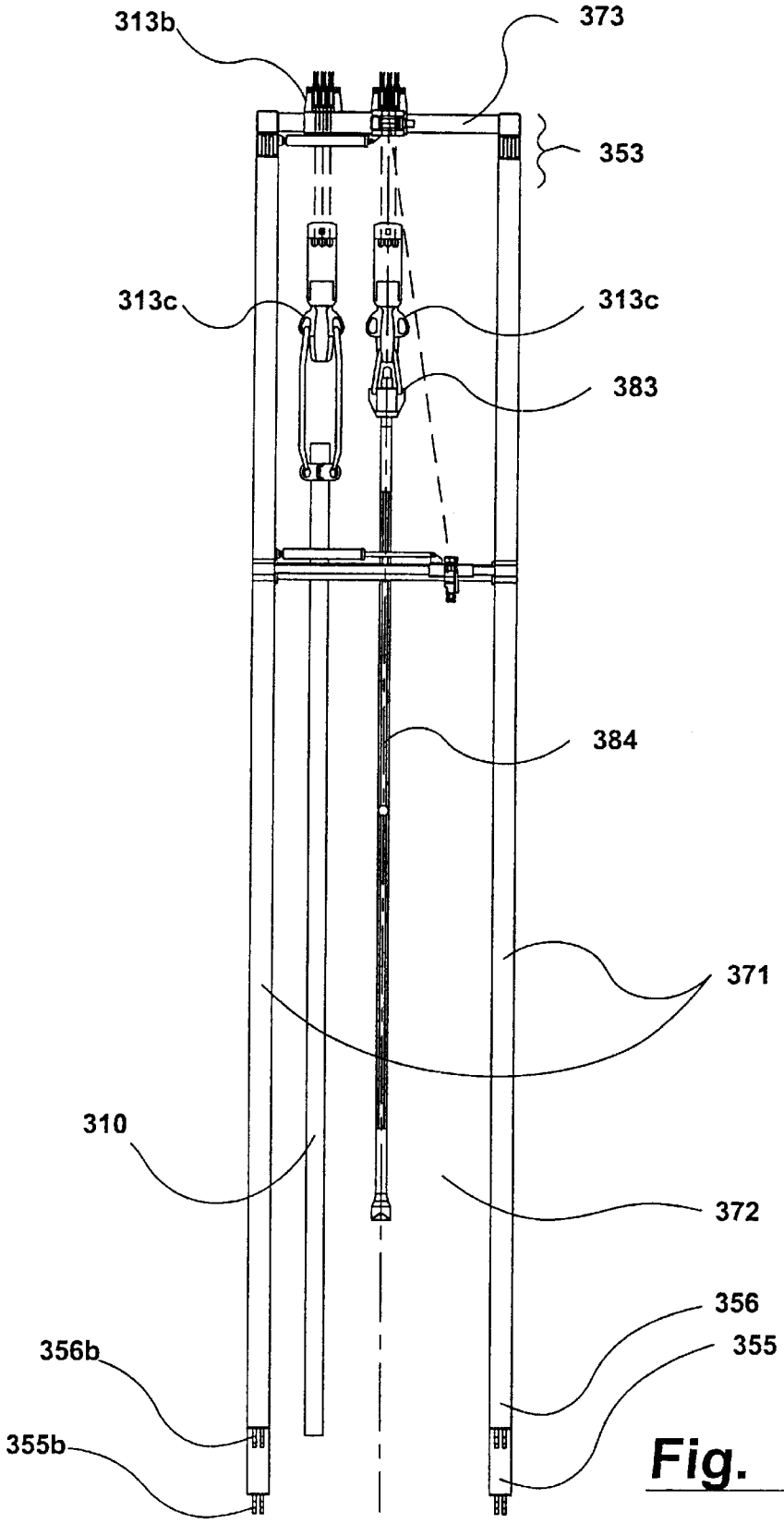
Figure 31A:
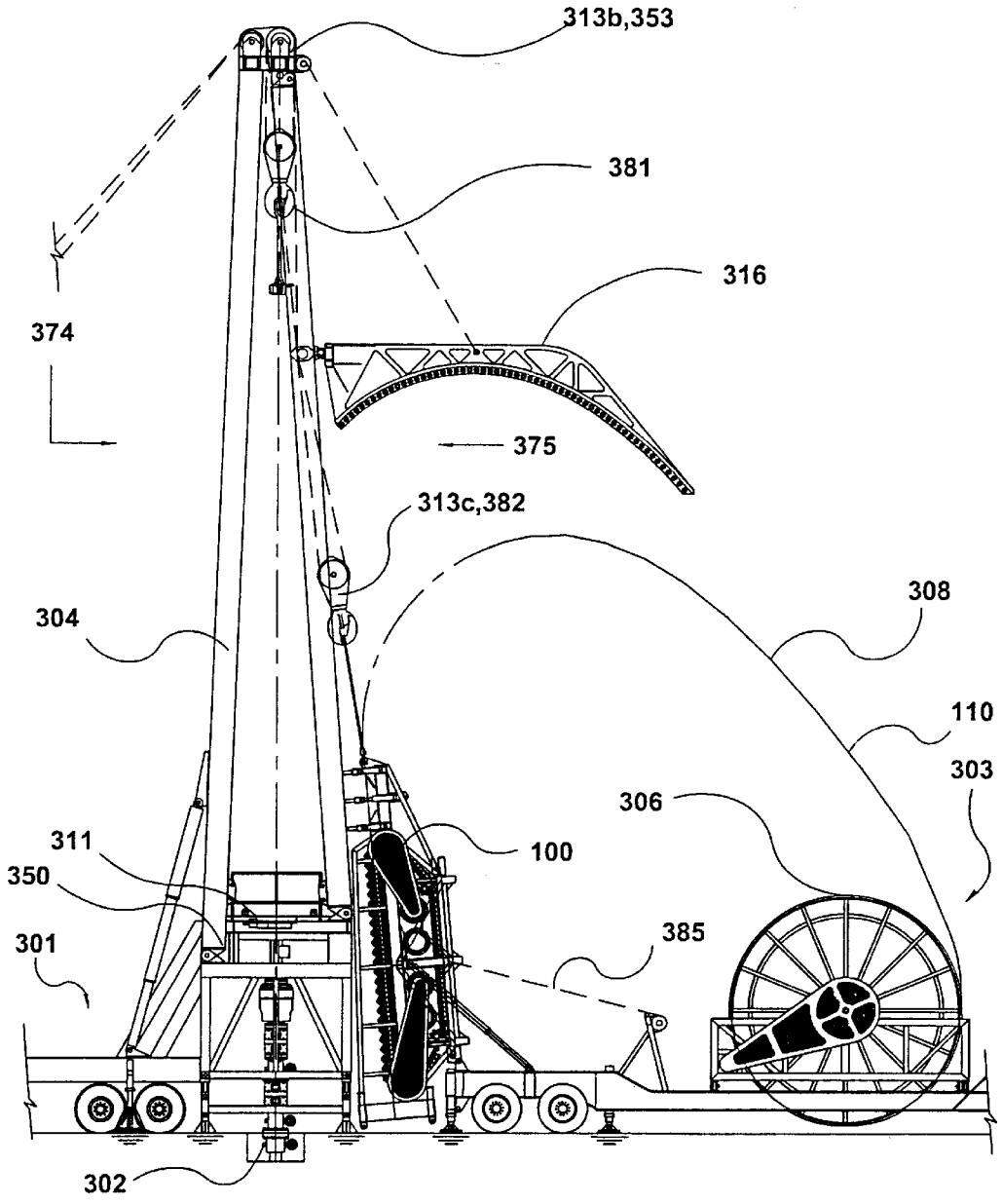
Figure 31B:
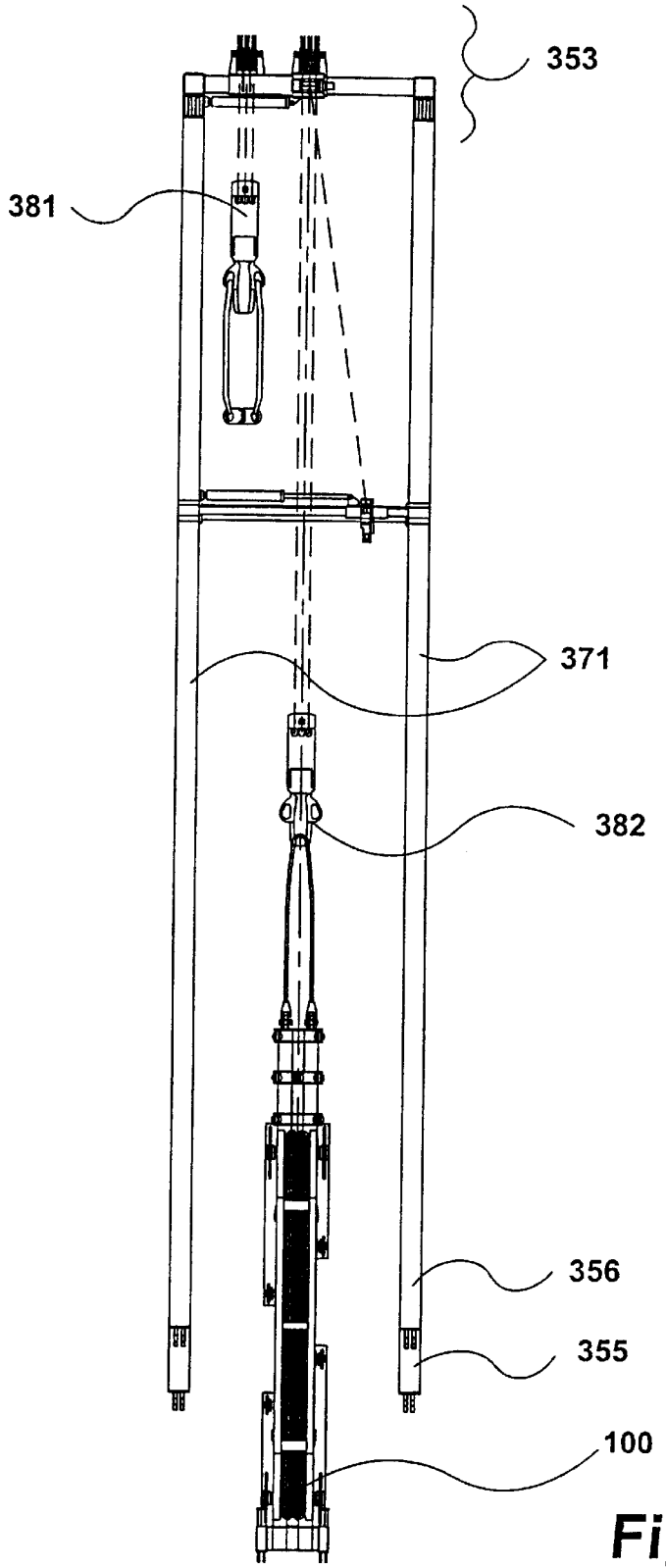
Figure 32:
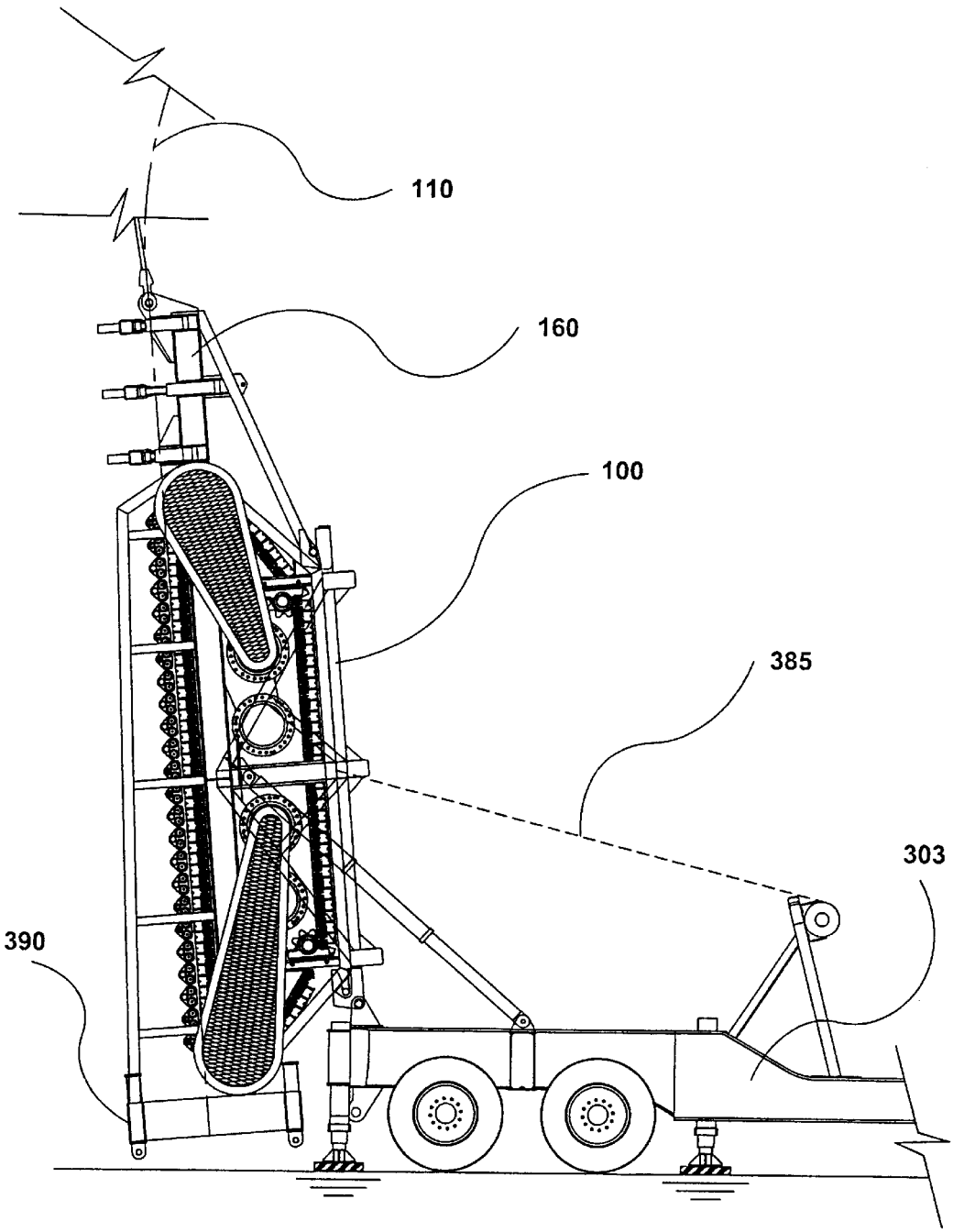
Figure 33A:
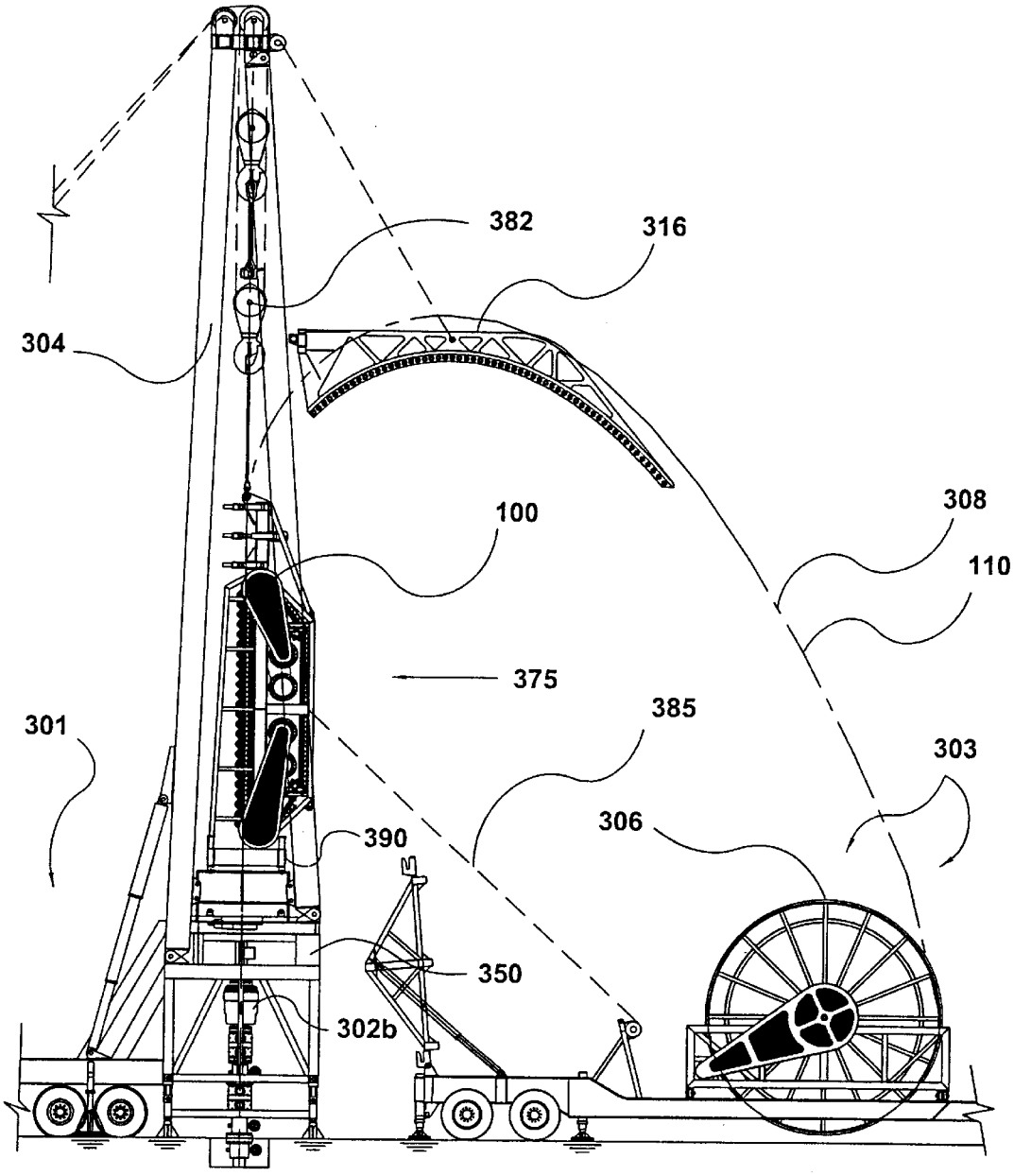
Figure 33B:
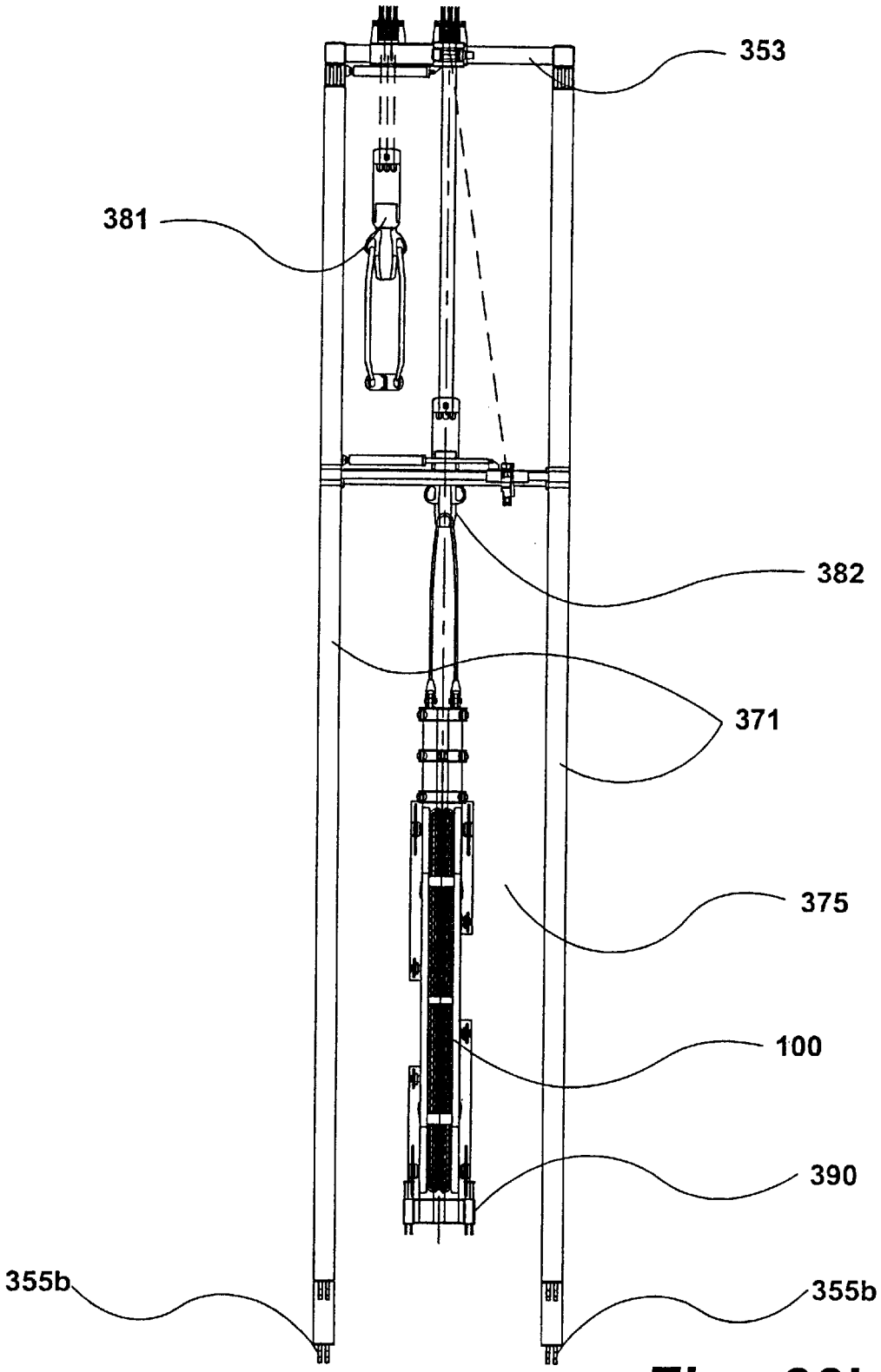
Figure 34:
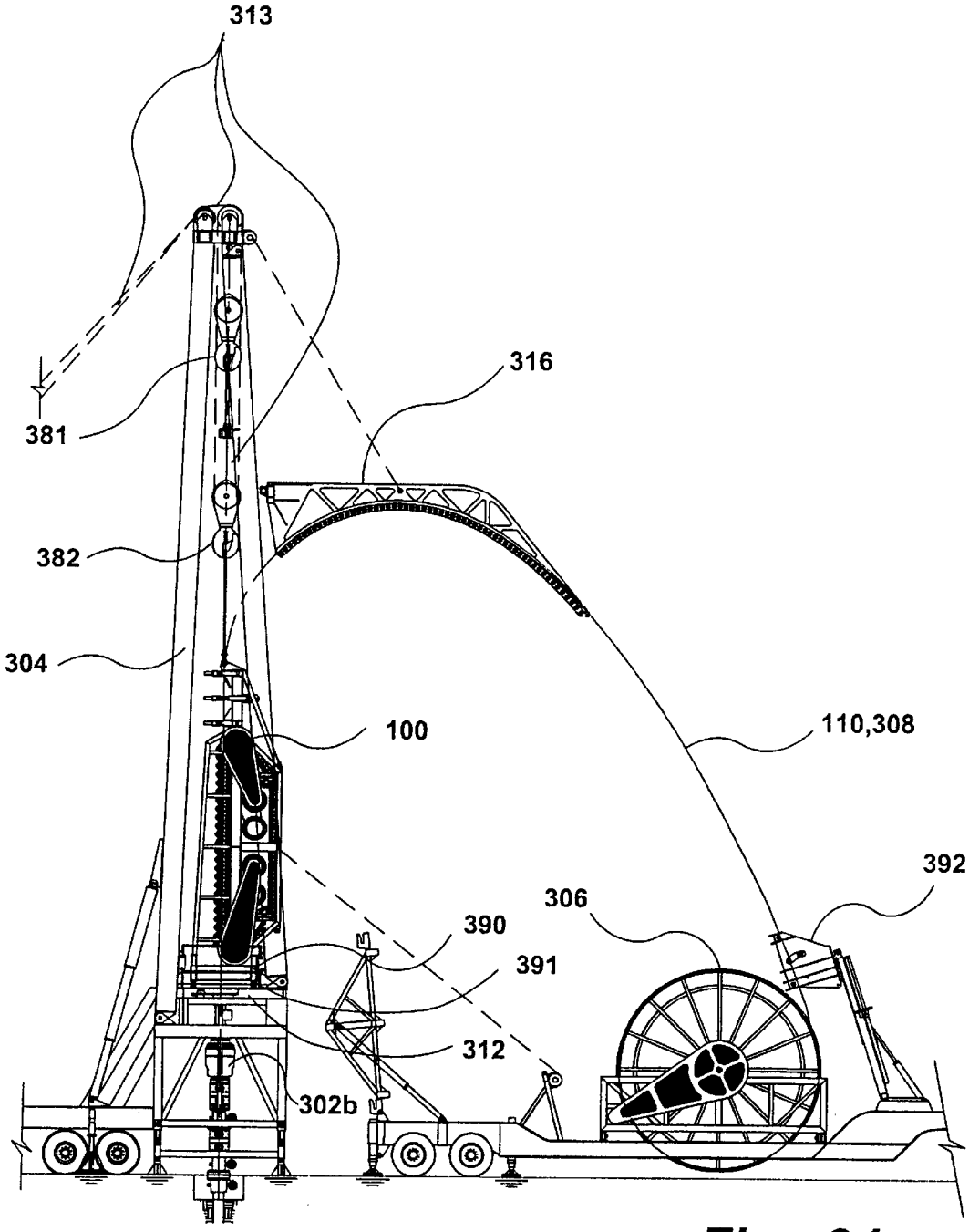
Figure 35A:
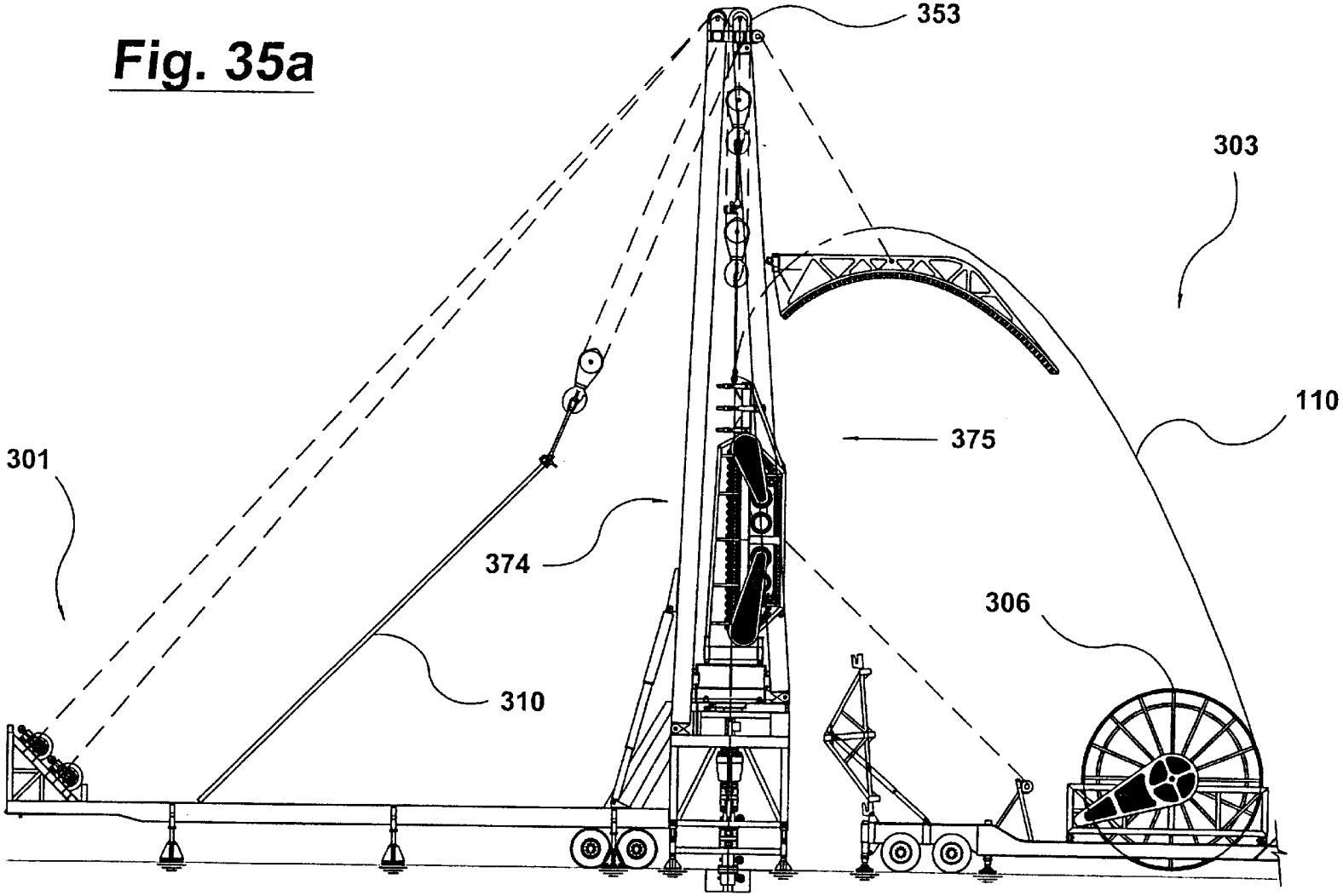
Figure 35B:
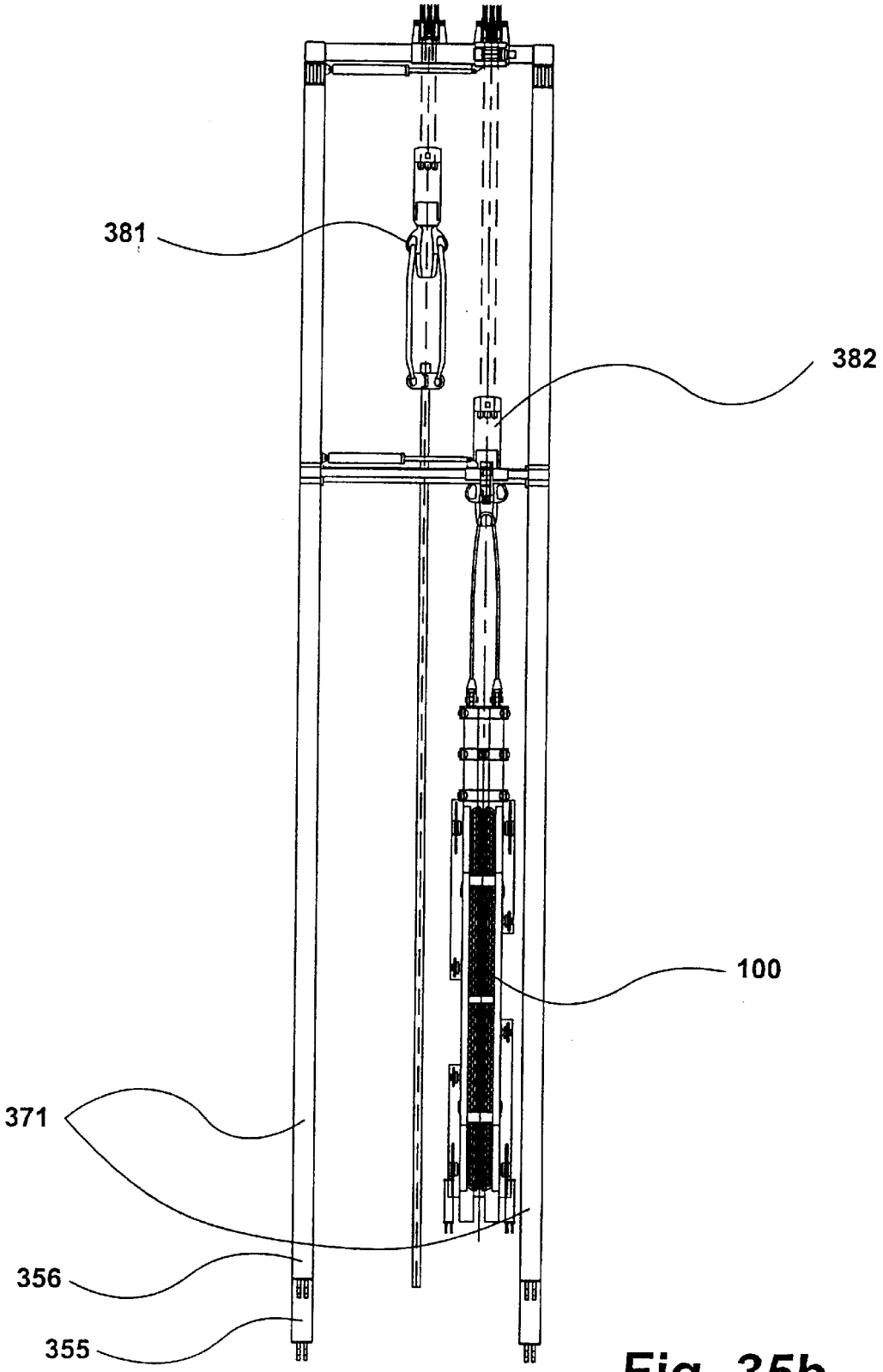

FIG. 27 is a side elevation view of one arrangement of a second embodiment of the hybrid conventional sectional and coiled tubing rig of the present invention. Sectional tubing is worked from the left open side and coiled tubing from the right open side through a dual duty mast;

FIG. 28 is a side elevation view of a sectional tubing trailer according to FIG. 27, the dual duty mast being in a shipping position on its trailer;

FIG. 29 is a side elevation view of a coiled tubing injector and reel according to FIG. 28, the injector being stored in a shipping position on its coiled tubing trailer;

FIG. 30*a* is a side elevation view of the sectional tubing trailer, with the mast erected, and with the crown positioned for drilling with a kelly, swivel and sectional tubing;

FIG. 30*b* is an end elevation view of the mast of FIG. 30*a*, with the crown shifted for drilling with the kelly aligned with the wellbore;

FIG. 31*a* is a side elevation view of the mast with the crown shifted for installing the linear injector and initiating feeding of the coiled tubing;

FIG. 31*b* is an end elevation view of the mast of FIG. 31*a*, with the crown positioned with the elevators set aside;

FIG. 32 is a close up side view of a compact linear injector, ideal for implementation in hybrid arrangements described herein;

FIG. 33*a* is a side elevation view of the mast with the crown shifted for landing the linear injector positioned in the mast and with coiled tubing poised to rest in the guide arch;

FIG. 33*b* is an end elevation view of the mast of FIG. 33*a*, with the crown positioned for manipulating the linear injector;

FIG. 34 is a side elevation view of the mast of FIG. 33*a* with the linear injector lowered and pinned in the mast for coiled tubing drilling;

FIG. 35*a* is a side elevation view of the mast with the crown shifted for setting the linear injector aside and for aligning the elevators for running in tubing or casing; and FIG. 35*b* is an end elevation view of the mast of FIG. 35*a*, with the crown shifted so that the elevators are aligned for running tubing or casing.

DETAILED DESCRIPTION OF THE PREFERRED EMBODIMENT

Linear Injector

Two embodiments of a novel injector are described herein. FIGS. 1–10 illustrate a particularly compact embodiment of an injector 100. FIGS. 16–18 illustrate a second injector embodiment 200, the variance between the two being characterized primarily in the packaging of the drives, the overall length of the coiled tubing gripping section, and the type of tubing holddowns. FIGS. 20–25 illustrate details of the gripper blocks common to both embodiments 100, 200. The novel concepts are common between the two preferred embodiments described herein.

Figure 1:
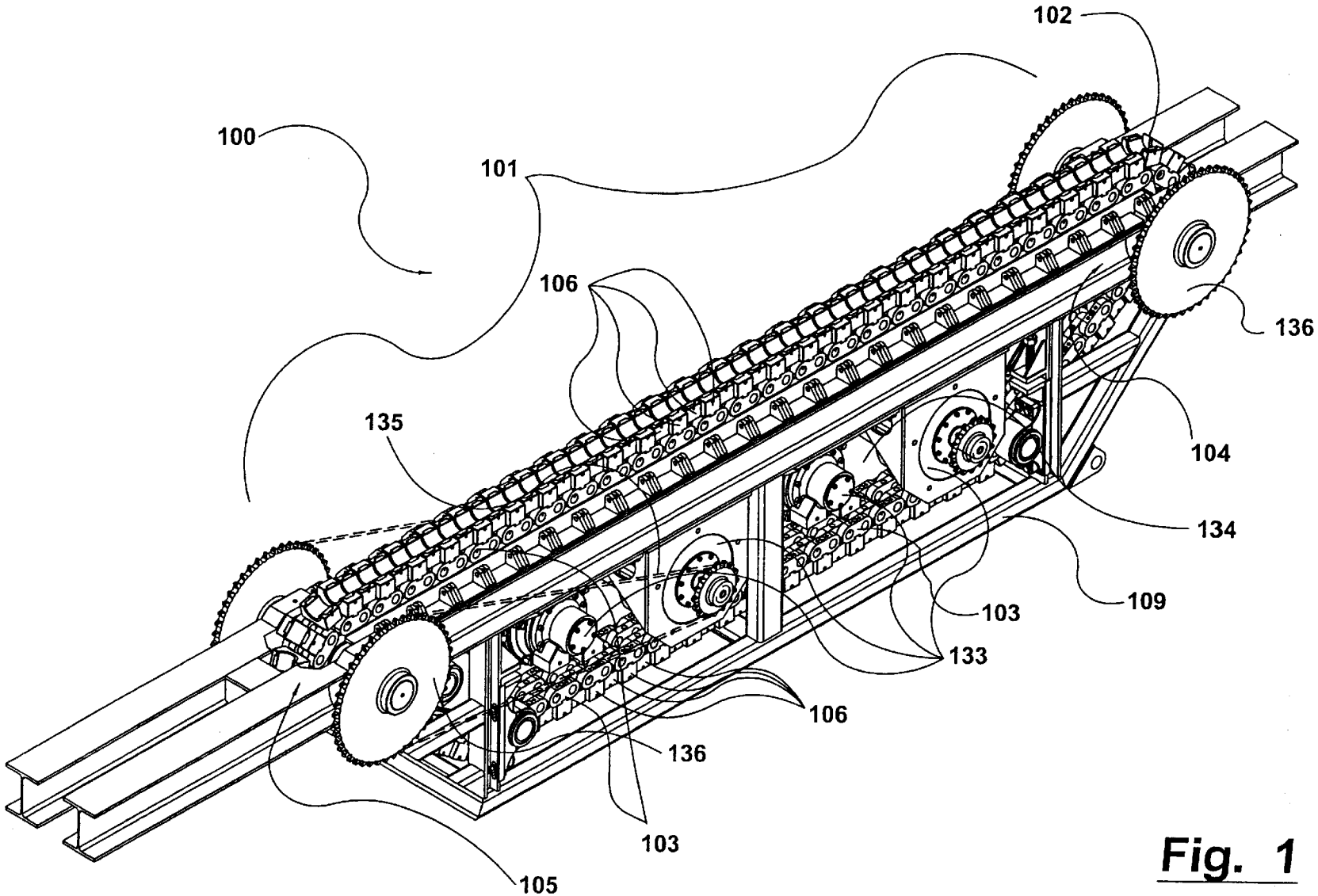
FIG. 1 is a perspective view of a linear coiled tubing injector according to one embodiment of the present invention; the holddown roller being removed for illustrating the tubing corridor.

Having reference to FIG. 1, a new coiled tubing injector 100 is provided which is characterized by a linearly extending section 101. This "linear" injector 100, in combination with a suitable support or mast (FIG. 12,27) can provide superior pulling capability, is gentle to coiled tubing and can also handle full diameter tubing, providing substantially all the advantages of both conventional sectional drill tubing and coiled tubing.

More particularly, and having reference to FIG. 1–5 and 16, the linear injectors 100,200 respectively comprise a continuous chain conveyor 102 fitted to a frame 109 having a chain 103 extending endlessly therearound.

As shown in FIGS. 2, 4 and 16–18, the continuous conveyor 102 is fitted with upper and lower drive sprockets 104,105. The endless chain 103 is fitted with a multiplicity of coiled tubing gripper blocks 106; one block 106 per link of the chain 103. The blocks 106 move with the chain conveyor 102. The blocks 106 are pivotally interconnected with pins 107 which engage the upper and lower drive sprockets 104,105. The moving gripper blocks 106 are formed with grooves 108 for accepting coiled tubing 110.

Injector Linear Section

Figure 3:
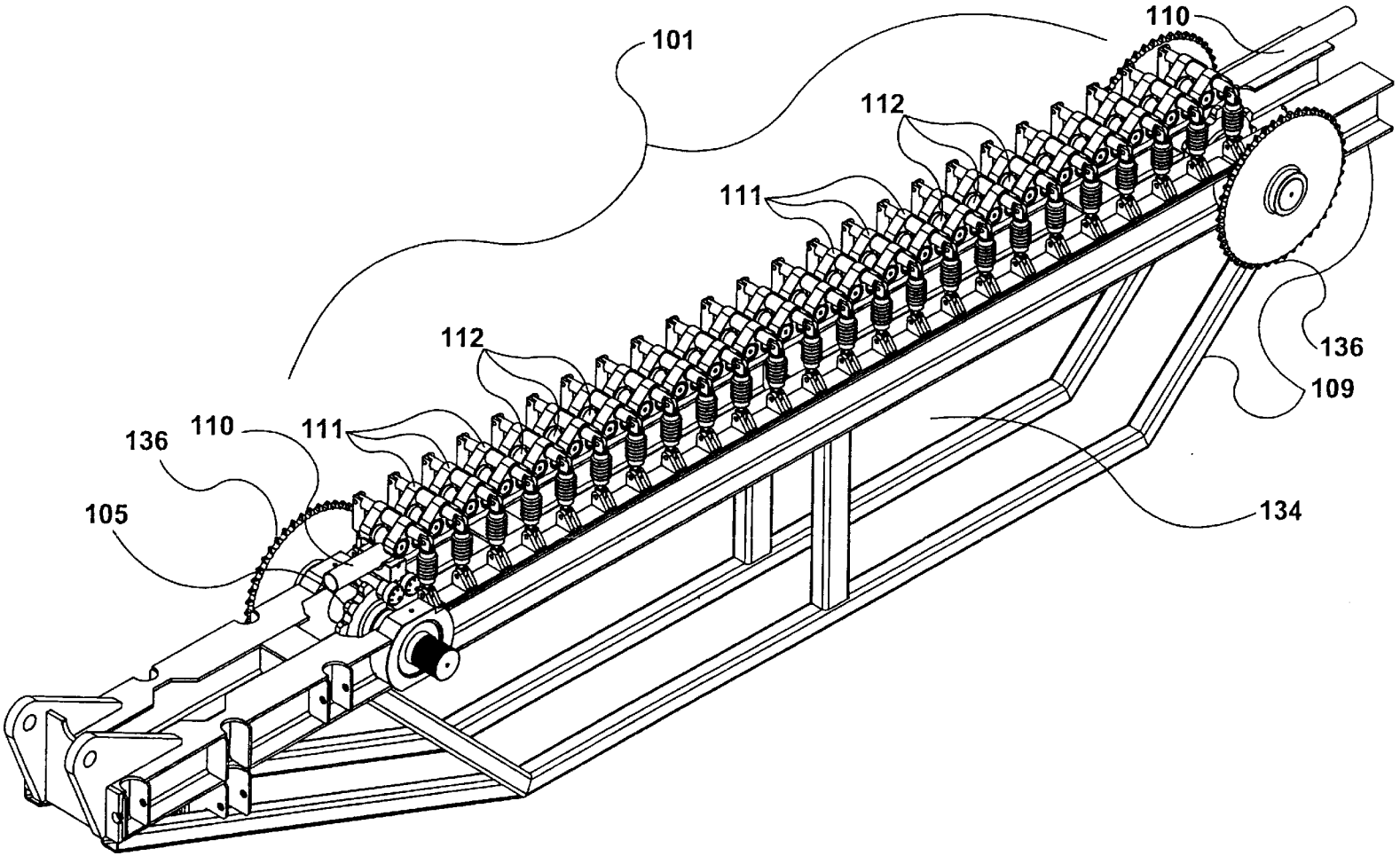
FIG. 3 is a perspective view according to FIG. 1 illustrating the array of holddown rollers. The continuous chain and drives are shown removed.
Figure 5:
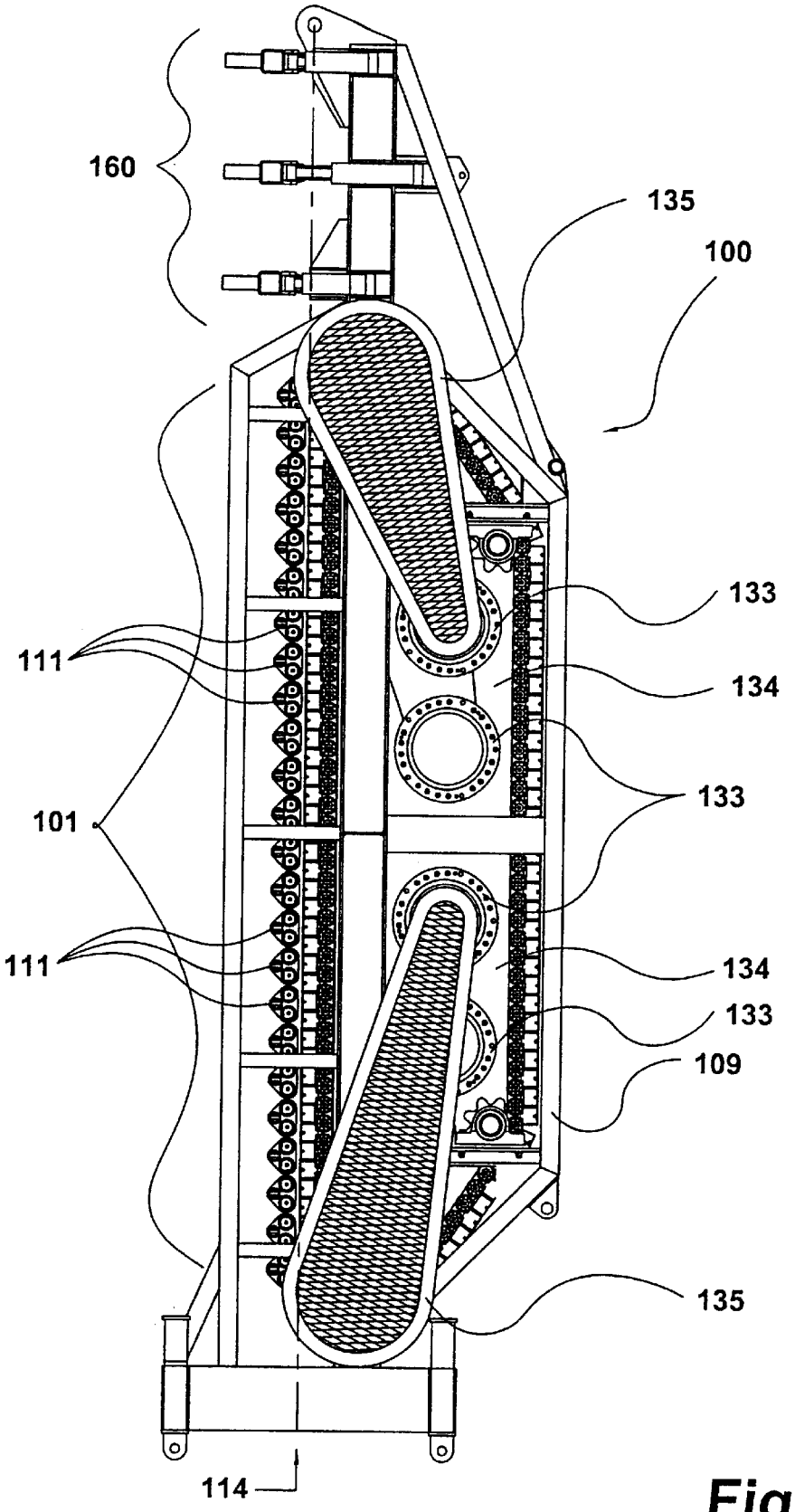
FIG. 5 is a side view of the linear injector having a tubing straightener atop the injector.
Figure 6:
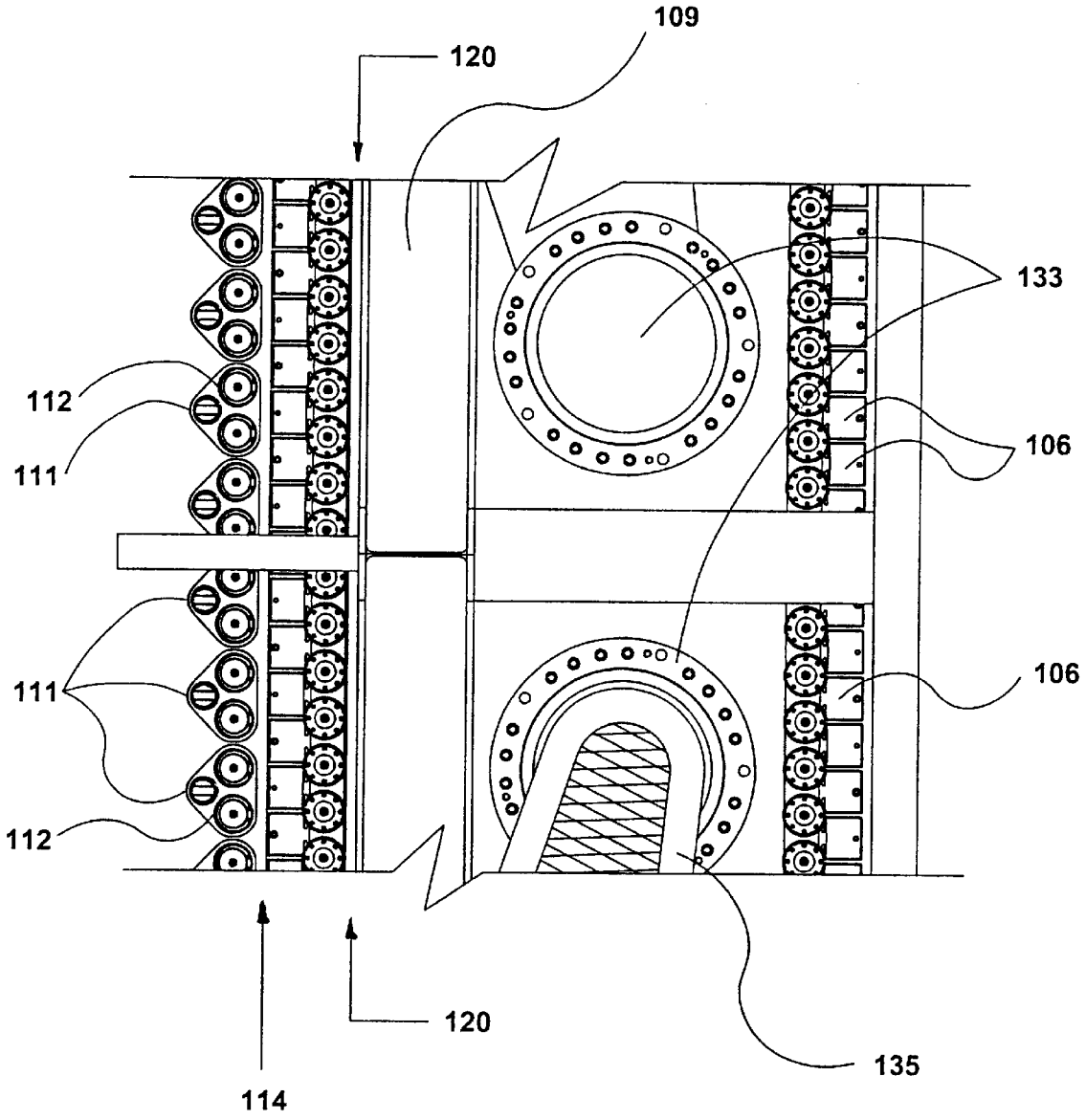
FIG. 6 is a close up, partial side view of the linear injector according to FIG. 5.

As shown in FIGS. 1, 3 and 5, one portion of the continuous conveyor 102 forms the linear section 101. A linear array 111 of complementary hold-down rollers 112 exert a normal force on the coiled tubing 110, urging it into the moving gripper blocks 106 and thereby frictionally engaging the coiled tubing 110 with minimal damage caused thereto. The relatively long length of the linear section 101, combined with a uniform coiled tubing gripping force, imposes large pulling force on the coiled tubing 110, resulting in significant pulling capability.

As a result, the capability of the linear injector 100 is even further expanded to include the injection and pulling out large bore coiled tubing 110 in deep well drilling operations.

Figure 2:
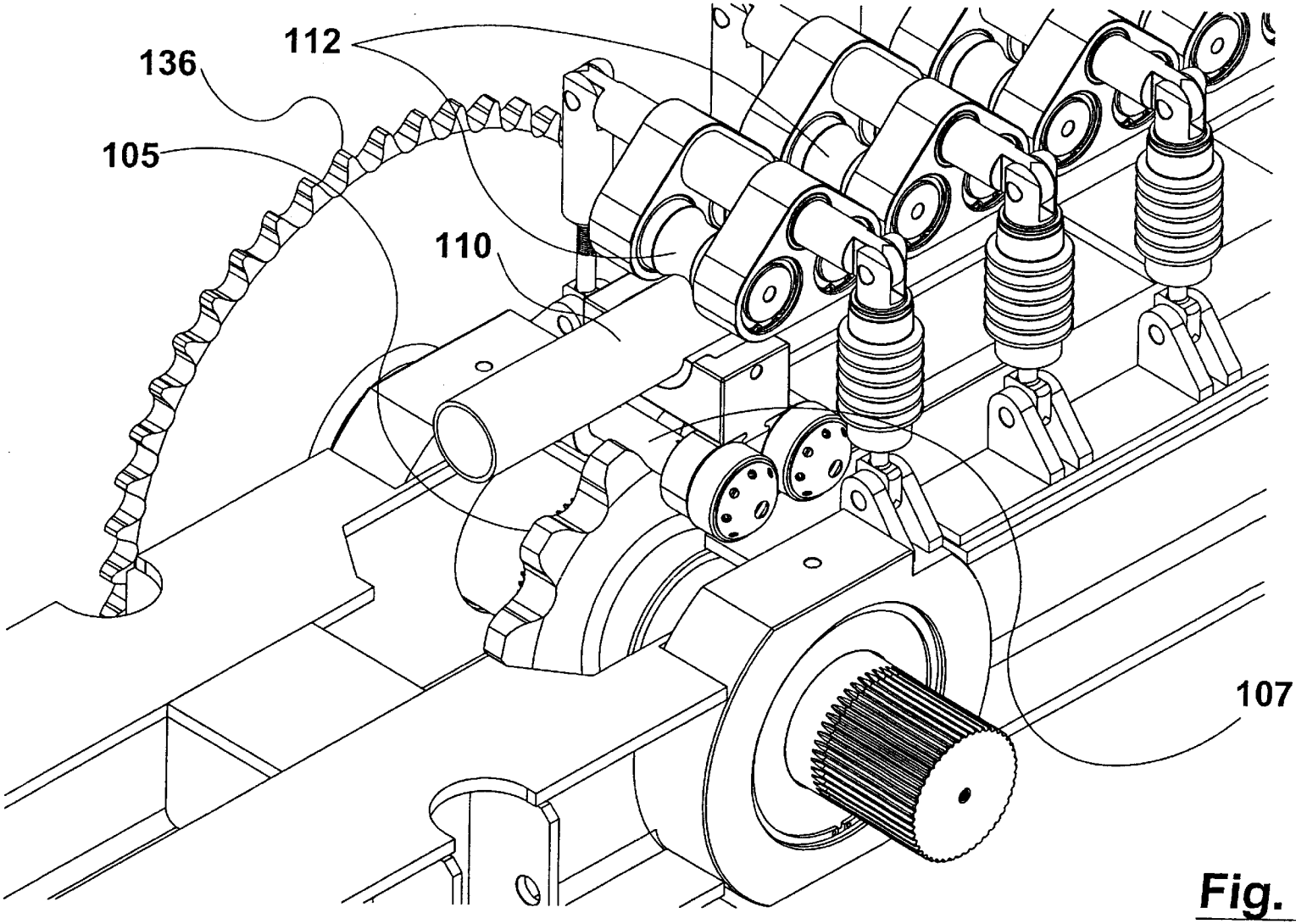
FIG. 2 is a close up perspective and partial view of the linear injector of FIG. 1, illustrating tubing being driven between the gripper blocks and the holddown rollers.

In more detail, and referring to FIGS. 2,3 and 5, the linear array 111 of hold-down rollers 112 comprises a multiplicity of these rollers 112, distributed along, parallel to and facing the linear section 101 of gripper blocks 106. The rollers 112 have corresponding grooves 113 to accept the coiled tubing 110.

A corridor 114 is formed between the opposing grooves 108,113 of the gripper blocks 106 and rollers 112. The coiled tubing 110 extends through the corridor 114.

Blocks & Block Track

The moving gripper blocks 106 are movably supported by skate or track means 120, located along the linear section 101, so as to resist the reaction force produced by the rollers 112 and thereby grip the coiled tubing 110 extending in the corridor 114 therebetween.

In first and second block embodiments shown in FIGS. 1–6, 20–25 respectively, the moving gripper blocks 106 themselves (roller gripper blocks 106*a*) form the continuous chain conveyor 102. This is in contrast to the independent assembly 106*b* of blocks 106 and chain 103 illustrated in a third embodiment shown in FIGS. 19*a*–19*c*.

Having reference to FIGS. 20 and 21, in a first block embodiment, each roller gripper block 106*a* comprises a block 106 formed with a semi-circular groove 108, fitted with a replaceable insert 121 which is sized to match the diameter of the coiled tubing 110 being used. The insert can have a tungsten carbide surface finish (not visible) placed thereon for increased longevity and gripping (friction) capability. The roller gripper blocks 106*a* have an offset link configuration having narrow first bifurcated prongs 122 and second wider bifurcated prongs 123. Adjacent roller gripper blocks 106*a*,106*a* interconnect with the first prongs 122 fitting between the wider second prongs 123 of the immediately adjacent roller block 106*a* with pin 107 pivotally connecting them together.

In a second roller block embodiment shown in FIGS. 22–25, again the moving gripper blocks 106 themselves form the continuous chain conveyor 102 and are fitted with the grooves 108 and inserts 121. In this embodiment, two types of roller blocks 116 are provided; one block 116*a* having closely spaced links 117*a* and another block 116*b* with widely spaced links 117*b*. Each roller block 116*a*,116*b* is mounted to (or formed with) a pair of parallel links 117*a*,117*b*, spaced sufficiently to enable the upper and lower sprockets 104,105 to pass therebetween (FIG. 25). As shown in FIG. 24, the roller pin 107, as per the first embodiment, passes transversely through the links 117*a*,117*b* for pivotally pinning them together.

Having reference to FIG. 25, the narrow spaced links 117*a* fit between the widely spaced links 17*b*, the narrow and widely spaced link roller blocks 116*a*,116*b* connected in alternating fashion and, when pinned together, form the continuous chain conveyor 102, shown wrapped about a sprocket 104,105.

The interconnecting pins 107 of any block 106 or specific configuration 106*a*,116*a*,116*b* are engaged by the upper and lower drive sprockets 104,105. As shown in FIGS. 21,24,25 and 17, the transverse or distal end of each pin 107 supports an idler assembly 122 having a bearing 123 and idler 124 which engages a backing track 120, enabling the blocks 106 to resist the normal force imposed by the rollers 112. The backing track 120 is conveniently formed by flat bar atop parallel "I"-beams 123 forming the structure or frame 109 of the linear injector 100.

In a third embodiment shown in FIGS. 19*a*–19*c*, separate gripper blocks 106*c* are provided as a separate component mounted to brackets 130 on roller chain 131. The continuous conveyor 102 can be supported along its linear section 101 by a linear skate 132, backing the roller chain 131.

The chain conveyor 102 is driven at one or both of the upper and lower sprockets 104,105 preferably with primer movers 133 such as hydraulic motors or planetary drives. As shown in FIG. 1, the path of the continuous chain conveyor 102 forms a periphery about an interior 134. Efficient use of the interior 134 results in a compact and narrow arrangement wherein four prime movers 133 are nested within the injector interior 134, using belted or chain transmission 135 coupled to sprockets 136 to drive the conveyor 102. In a less compact arrangement, illustrated in the embodiment of FIGS. 16–18, a direct planetary drive 137 is shown coupled and extending laterally and directly off the sprocket.

The prime movers 133 are reversible for providing injection force in one rotational direction and pulling force in the other rotational direction. The pitch of the conveyor chain 102 is minimized to reduce the diameter of the upper and lower sprockets 104,105, resulting in a reduced driving moment and reduced drive size.

Holddown Rollers

Figure 4:
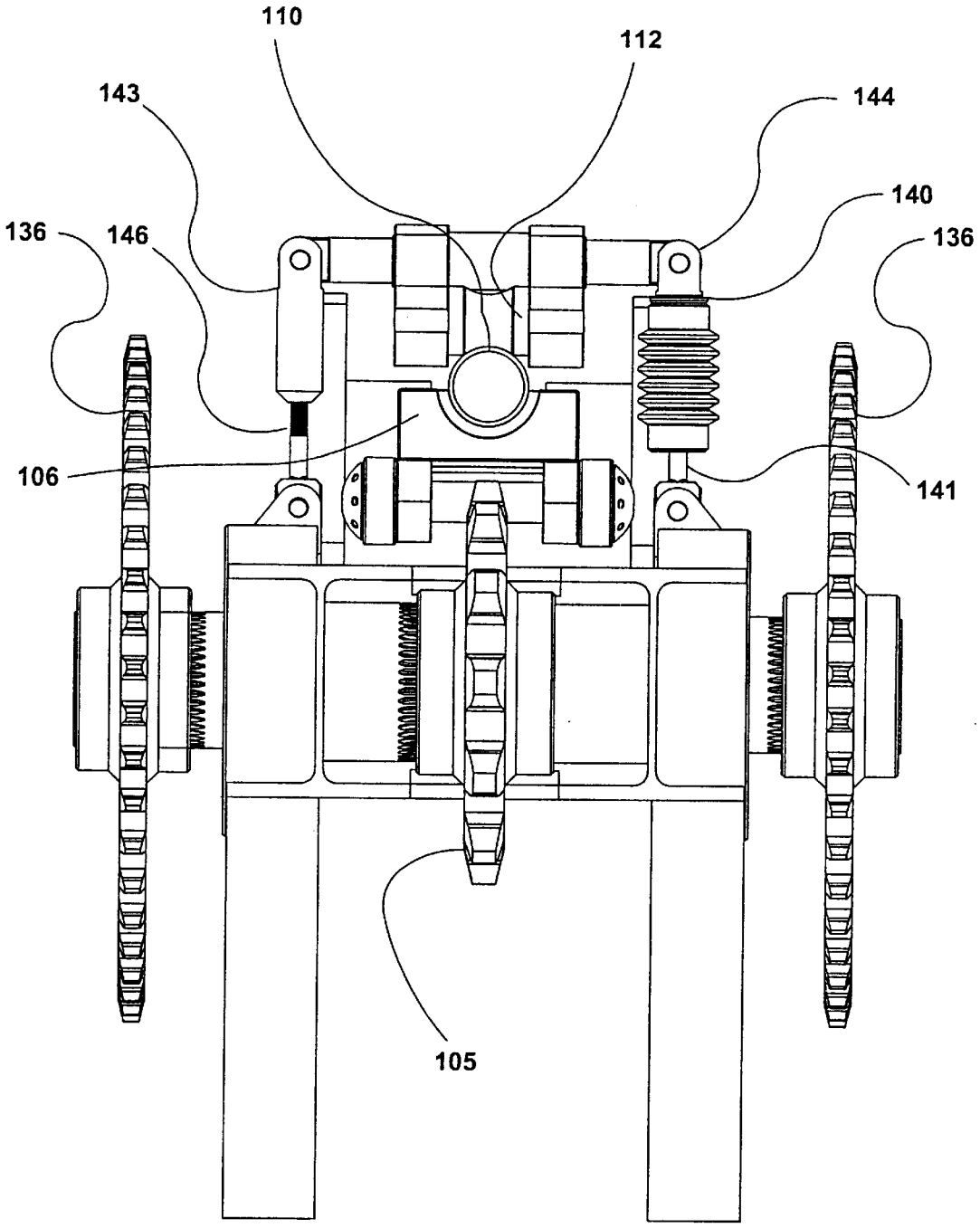
FIG. 4 is an axial view of the head pulley and cross-section through the tubing, illustrating a holddown strut.

Having reference to FIG. 4, biasing means are provided for urging holddown rollers 112 into engagement with the coiled tubing 110. First and second telescoping members 140,141 extend between the rollers 112 and the track 118 or frame 109. Spring means 142 (FIG. 10) are placed between first and second members 140,141 for maintaining compression on the coiled tubing 110. More particularly, a lateral and levered arrangement of complementary pairs of fixed and adjustable struts 143,144 urge holddown rollers 112 towards the gripper blocks 106 for sandwiching the coiled tubing 110 therebetween. The adjustable struts 144 form the spring means 142 and telescoping members 140,141. A plurality of these lever arrangements are provided in the array 111 along the injector's linear section 101.

Referring to FIG. 2 and 4, the rollers 112 are set using adjusting struts 144 for exerting a fixed and consistent force for the size of coiled tubing 110 used. Shown individually in FIG. 9 and in cutaway detail in FIG. 10, each strut 144 comprises a cylindrical housing 145 (of the first telescoping member 140), a shaft 146 (the second telescoping member 141) and conical spring or load-indicating washers 142. The strut 144 can only be pulled from the housing 145 by compression of the washers 142. The struts 144 set the appropriate load for maximizing normal force on the roller 112 without damaging the coiled tubing 110. Other elastomeric load-indicating washers (not shown) may also be used.

The complementary fixed struts 143 provide the fulcrum from which the rollers 112 are levered into engagement with the coiled tubing 110. Further, the fixed struts 143 incorporated a coarse threaded adjustment 146 for setting the position of the holddown rollers 112.

Figure 8:
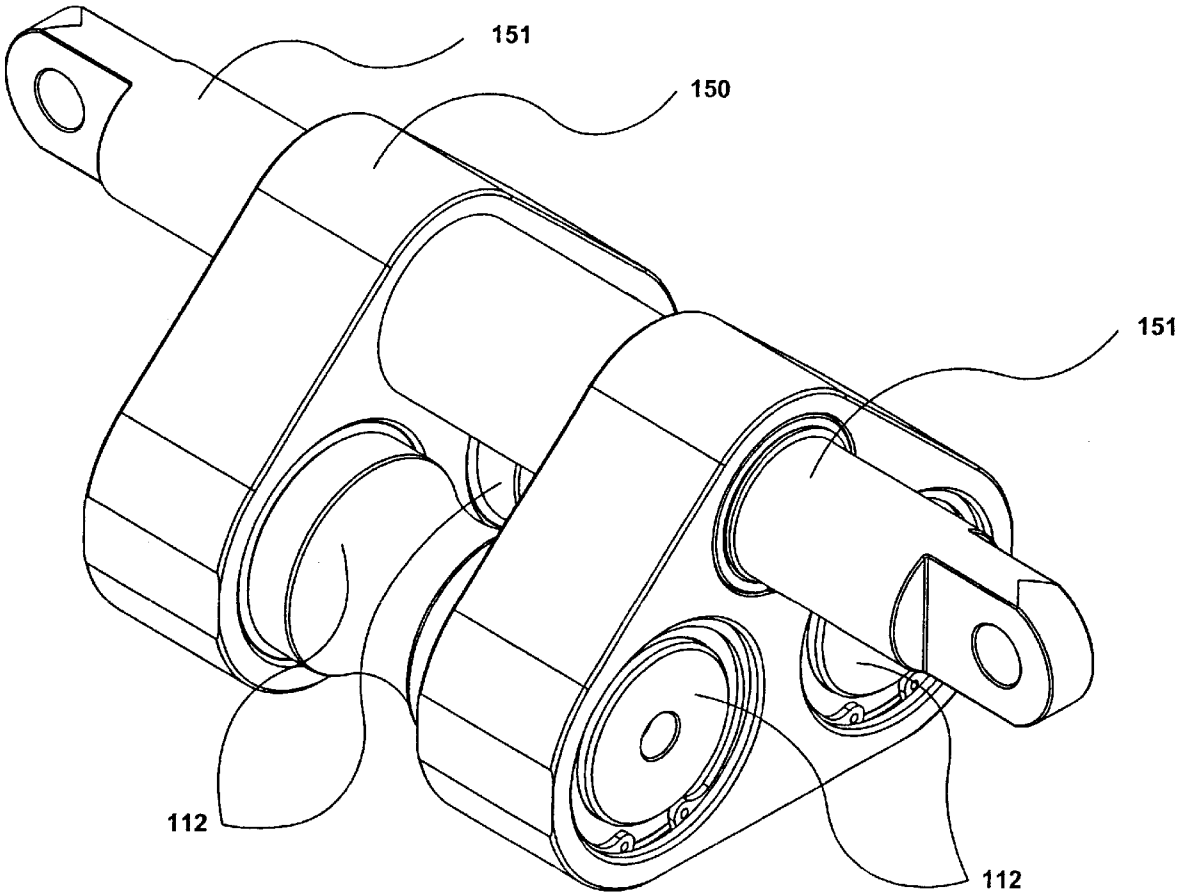
FIG. 8 is a perspective view of a pair of holddown rollers in a rocker housing.
Figure 9:
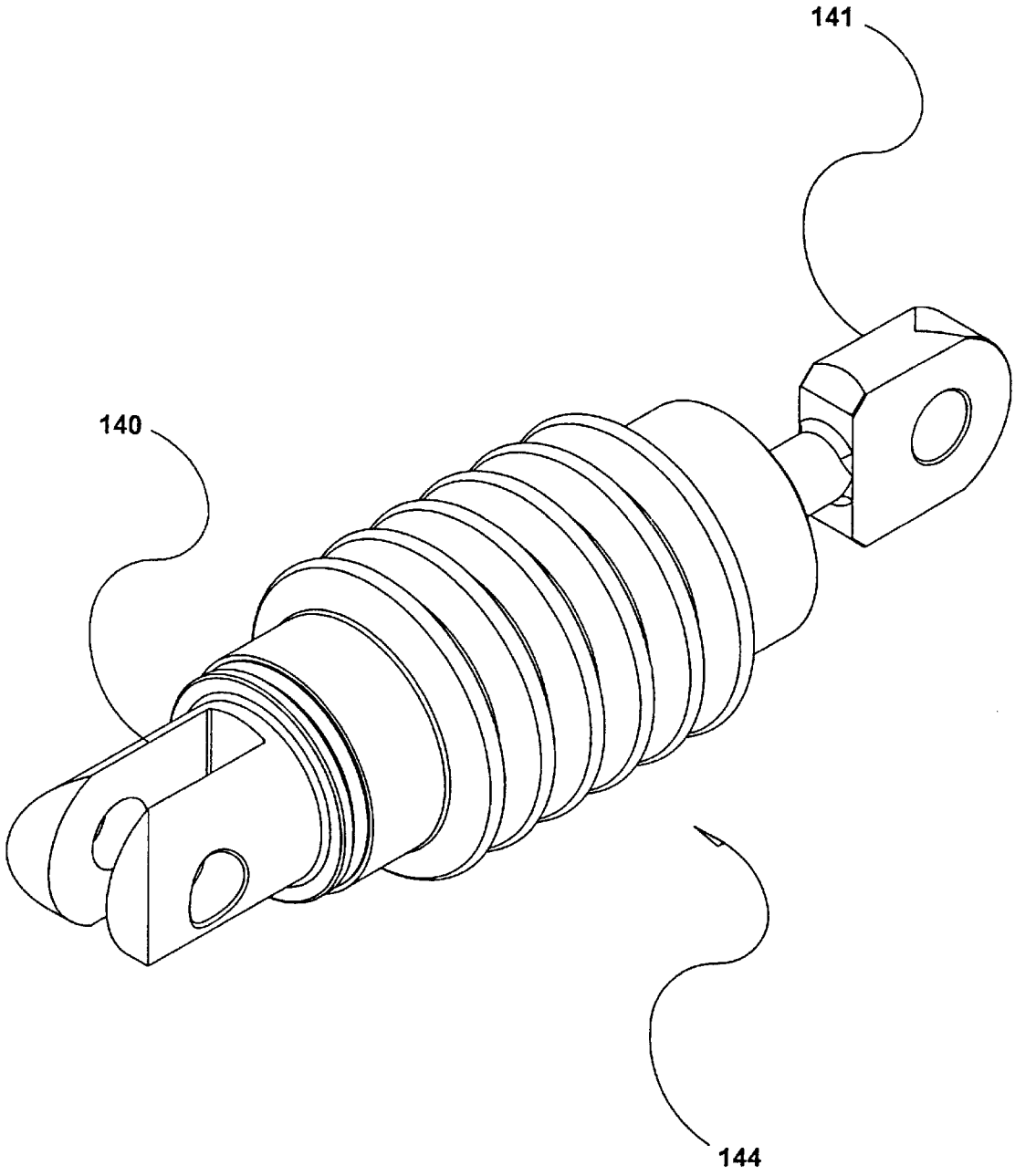
FIG. 9 is a perspective view of a belleville spring-equipped strut.
Figure 10:
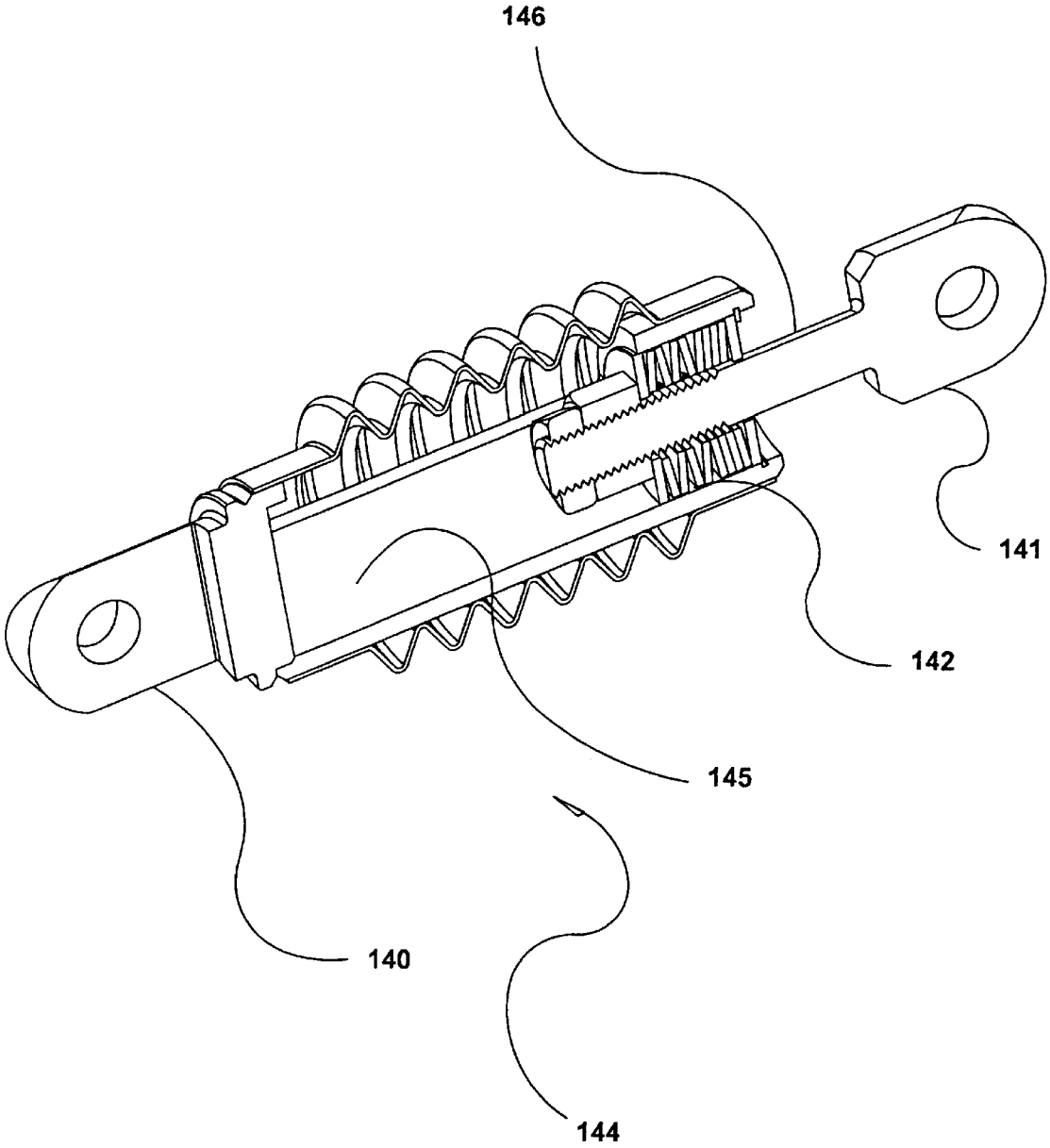
FIG. 10 is a cross-section of the strut of FIG. 9.

Referring to FIG. 8, the holddown rollers 112 themselves are provided in parallel pairs, rotatably fitted to a rocker housing 150. The rocker housing 150 has a single pivot shaft 151 which is secured at each end to the fixed and adjustable struts 143,144. The pivot and rocker housing 151,150 ensures that load is distributed between the two parallel rollers 112.

Optionally, and referring to FIG. 18, in optional embodiments, the force produced by the roller 112 can be dynamically adjusted using hydraulic actuators 147, further enabling the rollers 112 to adjust the normal gripping force or optionally to temporarily and sequentially lift the rollers 112 off the coiled tubing 110 or sectional tubing to pass an upset or other diameter variation. Accordingly, the long linear section 101 can also accommodate long rigid sectional strings (not shown). As a result, the linear injector 100,200 can be used in a variety of heretofore restricted applications including the injection of long strings of downhole tools or in the case of drilling operations, injecting and pulling out large bore coiled tubing 110 in deep well drilling operations.

For maintenance and adjustability, the rollers 112 can be grouped intoarrays 149 (FIG. 17), each having several rollers 112 (e.g. five) minimizing the number of hydraulic actuators 147.

Referring once again to FIGS. 5 and 17, a tubing straightener 160 is located at the upper end 41 of the linear injector 100,200 so that coiled tubing 110, without appreciable residual bend, is caused to enter the injector, reducing load on the gripper blocks 106 and rollers 112 and further so that coiled tubing 110 leaves the linear injector 100,200 straight. When withdrawing or pulling the coiled tubing 110 back up, the straightener 160 re-bends the tubing 110 to the lowest stress possible unsupported shape—preferably a parabolic shape.

Linear Tubing Pull Test Example

Figure 7:
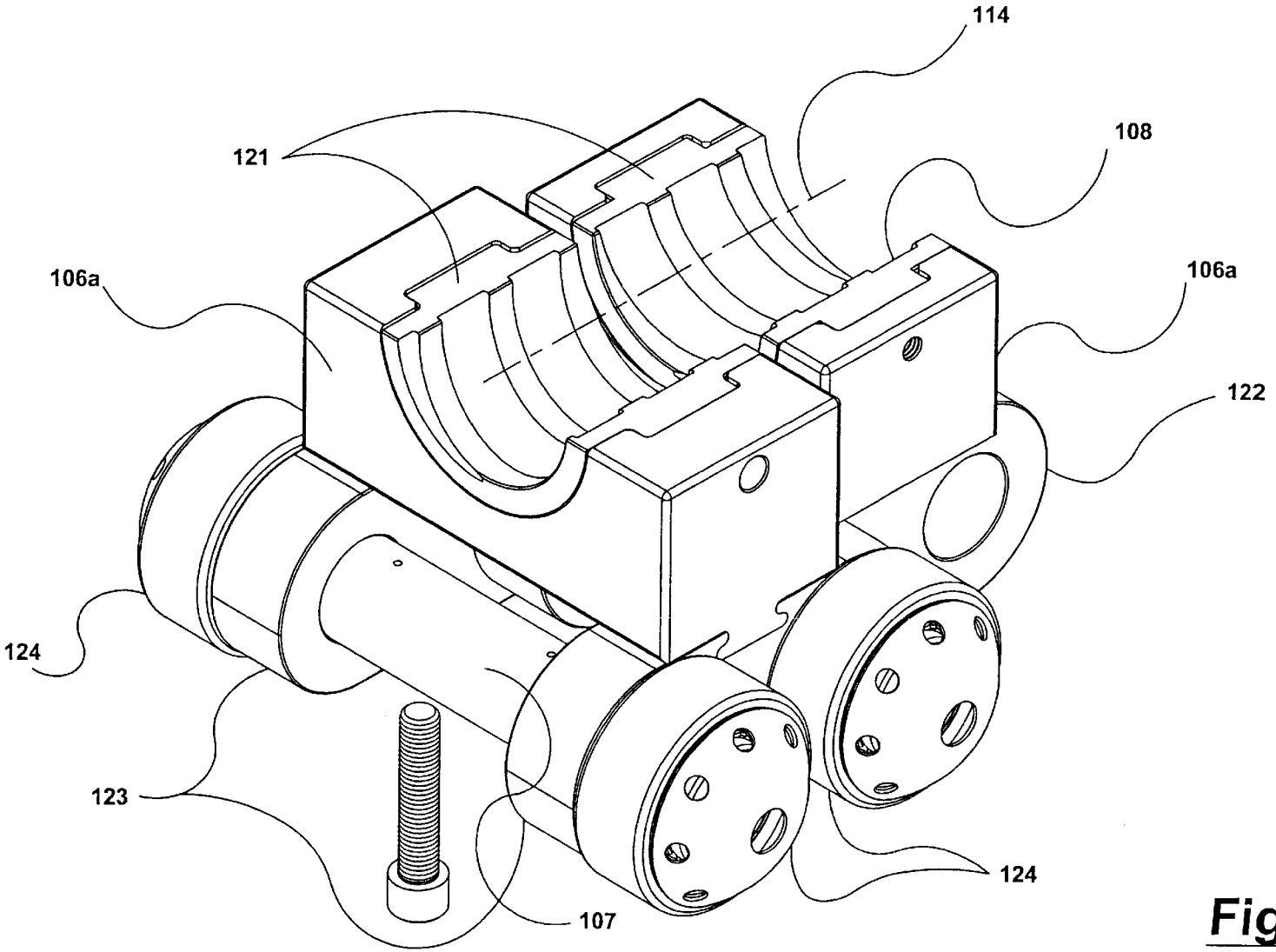
FIG. 7 is a perspective view of a matched pair of roller gripper blocks, the wider block being fitted with roller idlers, and one block assembly cap screw shown exploded from the assembly.
Figure 11:
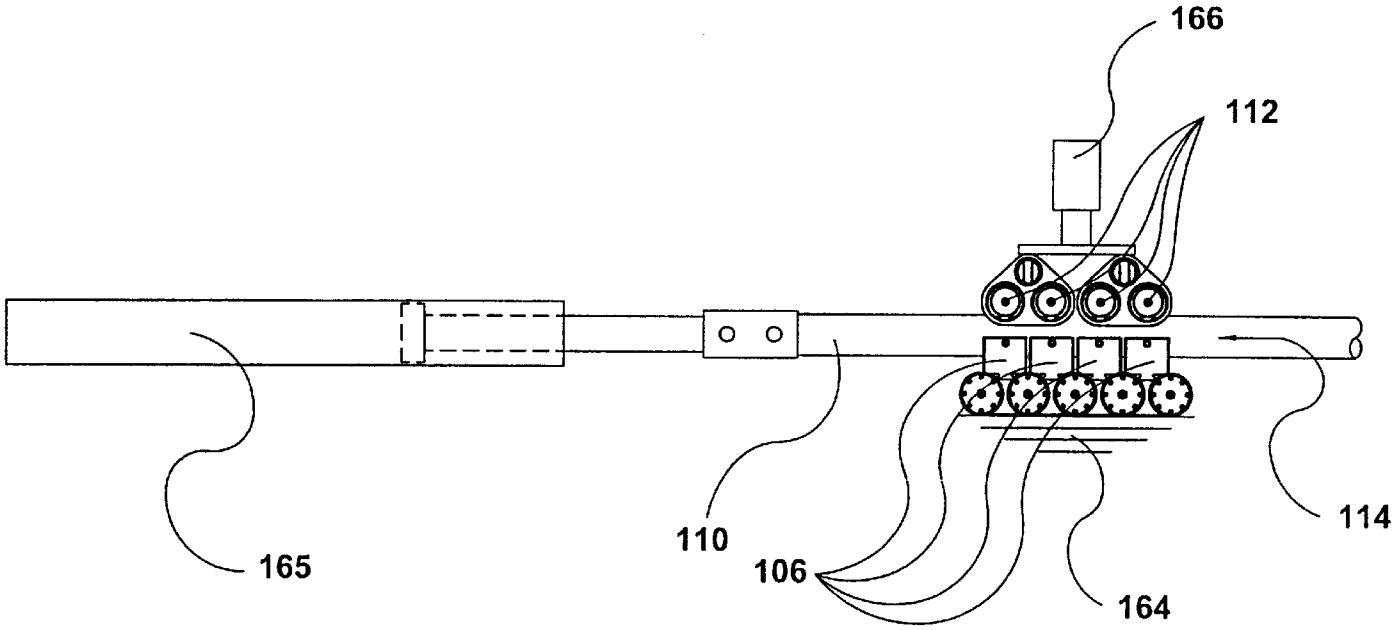
FIG. 11 is a side view of a pull test apparatus, utilizing four gripper blocks, four corresponding holddown rollers and a hydraulic cylinder, all according to the Example.

Having reference to FIG. 11, four gripper blocks 106 and corresponding holddown rollers 112 were constructed according to FIGS. 7 and 8 and in opposed relation to form the corridor 114. The gripper blocks 106 were anchored to a base structure 164 so as to be immovable. A length of tubing 110 was installed in the corridor 114 and affixed to a first hydraulic pull cylinder 165. A second hydraulic normal-force cylinder 166 forces the hold down rollers 112 into engagement with the length of tubing 110. Any movement of the tubing 110, indicating slippage of the tubing 110 in the gripper blocks 106, was measured by a dial indicator (not shown).

The first pull cylinder 165 had a 12.5 $in^2$ effective area or 1,250 lbs. of pull force per 100 lbs. hydraulic pressure.

The second normal force cylinder 166 had a 5.15 $in^2$ effective area capable of producing a total normal force of 20,600 lbs. at a pressure of 4000 psi. For four rollers, this became 5,150 lbs. per roller.

The four gripper block inserts 121 (not detailed) were sprayed with a friction enhancing tungsten carbide coating.

The pressure of the first pull cylinder 165 was increased until slippage occurred. Slippage occurred consistently at about 1000 psi. Accordingly, the pull force was about 12,500 lbs or each of the four gripper blocks 106 were holding up to 12,500/4 or 3,125 lbs. each. With the imposed normal force of 5,150 lbs. each, the coefficient of friction at slip was about 3,125/5,150 or 0.61. Assuming an efficiency of 80% to account for drive and friction losses in a full injector 100,200, the effective coefficient of friction is only 0.5 (0.61*0.80).

When extrapolated to a linear injector having an anticipated 48 blocks 106 and corresponding rollers 112, the corresponding and effective pull strength for 48 blocks would be 48*3,125 lbs.*0.80=120,000 lbs. at the point of slippage.

Hybrid Drilling Systems The linear injector 100,200 is particularly suited to use in combination with one or more arrangements of apparatus for conventional sectional drilling.

In a first hybrid embodiment (FIGS. 12–25), a conventional mast is implemented constructed in a style in common use today . A coiled tubing linear injector is arranged for installation and access through the same V-door as is used for handing conventional sectional tubing. Simply, in this arrangement, all drilling activity is performed through the same mast access.

In a second hybrid embodiment (FIGS. 27–35*b*), a portable, dual duty mast is provided which enables access from two sides. Accordingly, a coiled tubing injector can be arranged for access from one open side and sectional tubing from the second open side.

In instances where 2000 meters of well are to be drilled, typically one would utilize a mast capable of handling stands of 2 or 3 lengths of tubing. This requires a mast of 130–140 feet in height. However, by combining sectional with coiled tubing, a mast of only about 75 feet in height is required—set only by the length of tubulars being handled, the usual constraint being "Range-3", 45 ft. long casing.

Further, coiled tubing has only a cumulative weight of about 7 lbs./ft. compared to about 16 lbs./ft. with the associated sectional tubing having heavy collars and thicker walls.

Now it is appropriate to drill only about 4–500 ft. of surface hole with sectional tubulars, place surface casing, and drill the remainder of even very deep hole with coiled tubing.

With the ability to handle sectional tubulars, it is possible to quickly assemble drilling Bottom Hole Assemblies and drill immediately with coiled tubing.

Single Side Hybrid System

More particularly, having reference to FIG. 12, a conventional, sectional tubing, drilling rig (conventional rig) 201 is positioned at a well 202. The well is fitted with a Blow-out Preventor (BOP) 202*b*. A novel, coiled tubing transport rig 203 (CT Rig), according to the present invention, is also positioned at the well 202. For reasons elucidated in greater detail below, the preferred CT Rig 203 incorporates only means for transporting the novel injector 200 and does not include pumps and the like, and thus is substantially less complicated and less expensive than prior art coiled tubing injector rigs.

More particularly, the CT Rig 203 comprises a mobile trailer or truck frame 205 having a coiled tubing spool 206 mounted thereon. Conventional means (not detailed) are provided for managing coiled tubing dispensing and retrieving, including spool drives.

A curved feed arch 207 assists in directing the coiled tubing 110 approximately along a parabolic loop 208. The parabolic loop 208 has been found to be a low stress configuration for the loop of coiled tubing.

Best shown in FIG. 14, the CT Rig 203 forms a transport bed 208 for storing and transporting the linear injector 200 to the well 202. Once at the well, rather than utilizing the transport rig 203 to support the linear injector 200, it is mounted and supported in the mast 204 of the conventional rig 201.

As illustrated, the conventional rig 201 may comprise a mobile trailer 210, the mast 204 rising from substructure and a rotary table 211, at the drilling floor 212, to draw works 213 in the crown 214 and means for suspending the linear injector 200 in the mast 204.

The upper end 215 of the continuous conveyor 200 is fitted with second guide arch or gooseneck 216 for guiding the coiled tubing 110.

As shown in plan in FIG. 13, the CT Rig 203 and conventional rig 201 are oriented out of alignment for retaining full functionality of the conventional rig 201. Accordingly, a catwalk 217 and pipe rack 218 are able to access the drilling floor 212. Further, mud pumps 218 and mud tanks 219 accompany the conventional rig 201.

As described above and shown in FIG. 16 the linear injector 200 is a continuous conveyor 102 having an upper 215 and a lower end 225. As shown in FIGS. 28 and 29, the lower end 215 of the linear injector 200 is rotationally pinned in the mast 204 above the drilling floor 212. The linear injector 200 is hoisted into the mast 204. As shown in FIG. 15, a cable 220 from the mast's draw works 213 is directed about an idler 221 located about the monkeyboard and is attached to the upper end 215 of the linear injector 200.

Using the draw works 213 and cable 220, the upper end 215 is hoisted upwardly, pivoting the linear injector 200 about the bottom end 225 and into position. The linear injector 200 is aligned with the BOP 202*b*. The linear injector 200 is secured for suspending it in the mast 204.

The linear injector 200 can be alternated between two positions within the mast 204. In a first position, the injector is aligned with the BOP 202*b* for injection and withdrawal of coiled tubing 110. In a second position, the linear injector 200 is shifted or set aside in the mast 204 to take the injector out of alignment from the BOP 202*b*. When out of alignment, the mast 204 can be used in a conventional manner; more specifically to enable sectional tubulars to be pulled up the catwalk 217 and into the mast 204 and utilizing the rotary table 213 for making up the tubular's threaded joints.

By combining a conventional mast 204 with coiled tubing capability, a high capacity draw works 213 and a rotary table 211 are now available. Further, the physical distance placed between the conventional rig 201 and the source of the coiled tubing (the spool 206) enables the formation of a large radius parabolic loop 208 further allowing the injector rig to utilize large coiled tubing diameters, including 3.5 inch diameter typical for use in conventional rigs. The long linear injector 200 is capable of dealing with large lengths of coiled or sectional tubing. Further, use of the large fluid bore of 3.5 inch tubing 110 reduces fluid friction pumping power requirements from about 1000 HP to only 5–600 HP at 5,000 feet. It is postulated that a 5,000 foot deep well can be drilled in about ½ the time conventionally required due to the elimination of the need to make up joints every 30 feet.

The ability to use large bore 3.5", straightened coiled tubing 110 better mimics, as close as possible, performance capable with conventional sectional tubing; now providing: a large pulling capability needed for deep drilling; providing straight tubing with weight on bit control suitable for controlled drilling immediately; and even for drilling surface hole. Further, the aforementioned problems associated with residual bend can be avoided.

It has been determined that a 20 foot long linear section 101 provides pull capability on 3.5 inch tubing of about a maximum of 150,000 pounds, but if oil contaminated (soaked wet), this capability can drop to about 50,000 pounds. In practice, the pull capability would be in excess of 80–100,000 lbs.

The length of the linear section 101 is configurable depending upon the driving force required. Maximum length would be limited by the working height within the mast 204. For instance for a working height of about 50–60 feet, normally provided for making up stands of sectional tubulars, the linear section 101 of the injector 200 could be upwards of 30 feet tall. The straightener 160 and a coiled tubing guide gooseneck must also be accommodated in the mast 204.

Further, the hybrid arrangement simplifies the assembly and use of Bottom Hole Assemblies (BHA). A BHA includes the bit, mud motor and measurement equipment, which must be made up and can be in the order of 30 feet in length. Conventional coiled tubing drilling units have tried various means to make up the BHA, requiring the various pieces to be threaded together. This is usually a labor intensive job because coiled tubing units are not normally set up to rotate tubing to make up the joints. Occasionally drill collars are also threaded onto the BHA to provide startup drilling weight or improve linear stability.

Further, by combining a conventional mast 204 with the linear injector 100,200, the capital costs of the whole operation are reduced. A rig transporting a linear injector 100,200 need not have a mast, nor fluid pumping equipment and can simply include the coiled tubing injector 200 and spool 206 The conventional mast 204 provides the capability of lifting at the required high pull forces and through the use of the rotary table 31 enables readily making up BHA and connections onto the non rotating coiled tubing 11.

In yet another application, as shown in FIG. 26, the linear injector 200, applied without a conventional mast, is particularly well suited for shallow directional drilling or the insertion of downhole tools such as pumps or for workovers, and is able to provide continuous, straightened tubing into any well, including a slant wellhead and BOP 202*b*. Without the need for a rotary table or strong draw works, the linear injector 200 can be located on its own trailer 203 and does not require further mast superstructure. As shown in FIG. 26, the linear injector 200 can be transported prone (stage (a)), raised partially for injection through a slant wellhead/BOP 202*b* (stage (b)) or raised completely for injection down a vertical well (stage (c)). A BHA for directional drilling or a pump can be pre-assembled and carried on an integrated coiled tubing injector rig for injection without additional equipment.

Dual Duty Hybrid System

Having reference to FIG. 27, in a preferred embodiment of the system, two rigs are again provided; one of which provides sectional tubing and the second providing coiled tubing. A first rig 301 comprises a collapsible mast 304 on a first trailer, a substructure, rotary tubing drive means 311 (table or power swivel), side shifting crown 314, dual blocks 313*a* and dual drawworks 313. In this description, dependent upon the context, the term drawworks 313*b* is also used to describe the winches 131*d*, cable 313*e*, crown pulley 313*b* and blocks 313*a* in combination. Further, while the block 313*a* also includes a hook 313*c*, it is understood that drawworks 313 includes means for attaching various tools, such as a hook 313*c* for handing elevators, swivels and the injector 100.

An integrated hydraulic system (not detailed) powers the drawworks 313, side-shifting crown 313*b*, rotary table 311 and lifts the collapsible mast 304.

A second rig 303 comprises a coiled tubing injector and a reel of coiled tubing on a second trailer. Suitable support equipment is provided such as a mud system, mud pump and control house.

Having reference to FIG. 28, the first rig 301 is transported to a well in a transportable, collapsed form. The substructure 350 is located at the trailer's back end 351. The substructure 350 is optionally equipped with a wellhead and BOP 302*b* for centering over the well 302. The rotary table 311 is installed in the substructure 350 for positioning over the center of the BOP 302*b*. The mast 304 has its crown 353 and a base 354 formed of two support structures 355,356 pivotally connected at the crown 353 and having a transverse dimension about that of the width of the trailer 305. In its collapsed form, the two support structures 355,356 lie substantially parallel to the trailer 305, arranged as one lower support structure 355 and one upper support structure 356 . The clearances of the top of the substructure 350 and the top of the upper support structure 356 are both optimally low enough for highway travel.

The lower support structure is pivotally connected at its base 355*b* to the substructure 350. The base 356*b* of the upper support is free for subs frequent pinning at 356*c* when erect. Hydraulic rams 357 are located between the mast's lower support structure 355 and the trailer 305 and, when energized, drive the mast 304 into the erect position.

Having reference to FIG. 29, the coiled tubing injector 100 is positioned at the second rig's back end 370. A coiled tubing supply reel 306 is positioned mid-tailer and is capable of storing up to 6500 feet of 3½ inch tubing, 8500 feet of 2⅞" tubing or 12,000 feet of 2⅜" tubing.

Having reference to FIGS. 30*a*, 30*b*, the erected lower and upper support structures 355,356 are designed to support the compressive loads of pulling tubing without the requirement for significant cross bracing. As shown in the end view of the mast in FIG. 30*b*, each of the lower and upper support structures 355,356 are formed of a pair of spaced legs 371 constructed of hollow structural tubing depending downwardly from the crown 353. Between the legs 371 is formed a large open side 372, suitable for tubing access. The crown 353 comprises a horizontal beam 373 and ties the two pairs of legs 371 together.

As shown in FIG. 27 and 30*a*, when erected, the crown 353 is positioned over the well 302. The trailer 305 itself forms a catwalk 317 for handling conventional sectional tubing or tubulars 310.

Referring to both FIGS. 30*a* and 30*b*, the crown 353 is shown equipped with a shifting crown 313*b* comprising a first block 381 and second block 382 movable laterally in the crown 353. The first and second blocks 381,382 are alternately positionable one or the other over the well 302. Each block 381,382 has means, such as a hook 313*c*, for attaching various tools. Specifically, as shown in FIG. 30*b*, the second block 382 is shown, fitted with a hook 313*c*, a swivel 383 and a kelly 384. The kelly 384 is driven by the rotary table 311 for drilling purposes.

Having reference to FIG. 31*a*, the first and second rigs 301,303 are arranged back end 351 to back end 371. The mast 304, when erected, has a first side open 374 to the trailer 305 of the first rig 301 for forming a catwalk 317 for drill pipe, casing or tubulars 310 generally. The opposing side of the mast 304 is open to the second coiled tubing rig 303. Accordingly, lengths of sectional tubulars 310 can be handled or drawn up the first open side 374 from the first rig 301; and coiled tubing 110 can be introduced from the second open side 375.

The coiled tubing rig 303 is not necessarily provided with a guide arch. Conveniently, a guide arch 316 is instead pivotally connected to and shipped with the mast 304. In preparation for use, the guide arch 316 is pivoted out from the upper support structure 356 so that it projects laterally therefrom.

Having reference to FIGS. 31*a*, 31*b* and 32, the coiled tubing injector 100 is released from its shipping condition. One of the blocks 382 (the second block being shown) is lowered to capture the injector 100 for lifting it into the mast 304. As the injector 100 is lifted, the coiled tubing 110 is spooled off of the reel 306. An objective is to maintain a gentle loop, such as a parabolic shaped loop 308, for minimizing stress in the coiled tubing 110. Cables 385 stabilize the injector 100 as i t is lifted and prevent it from colliding with the mast 304.

Next in sequence at FIGS. 33*a*,33*b*, the injector 100 is hung in the mast 304 and the coiled tubing 110 is aligned over t he guide arch 316.

Finally, at FIGS . 34*a*,34*b*, the injector 1100 is landed on the substructure 350. A chair structure 390 at the bottom of the injector 100 couples with a corresponding base structure 391 on the substructure floor 312. The chair 390 and base structure 391 telescope to permit several feet of vertical movement by the injector 100 but constrain the injector 100 aligned over the BOP 302*b* and well 302. The weight of the injector 100 and the coiled tubing 110 is borne by the drawworks 313.

The coiled tubing 110 is set into the guide arch 316. The optimal curve in the coiled tubing is known as a parabolic loop 308. A level wind 392 is provided for stabilizing the coiled tubing 110 as it traverses across the reel 306 as it spools on and off.

The coiled tubing injector 100 can be of any design which is capable of fitting in the mast 100 with enough spare lateral room to permit the injector 100 to be shifted out of the way and to permit the other block 381,382 to be aligned with the well 302. The linear coiled tubing injector 100 as described above meets such criteria. With the prime movers 133 offset from the drive sprockets and set within the interior 134 of periphery of the continuous chain, the depth of the injector 100 can be a narrow as three feet, and when idle, can be set aside in the mast 304, such as when handling tubulars 310 (drill tubing or casing).

Drilling with coiled tubing 110 is now possible with the injector 100 being operated as described above.

In operation, the dual drawworks 381,382 are optimized to perform simultaneous operations and, as much as possible, minimize serial handling. For example, rather than utilizing a rotary table 311 and kelly 384 to both drill, then serially handle the next length of drill tubing 310, the first block and drawworks 381 could be lifting the sequential tubular 310 while the previous tubular is being run in with the second block and drawworks 382.

Further, in another aspect, optimal modes for drilling, whether it be using sectional tubulars 310 or coiled tubing 110 may vary from site to site. The hybrid apparatus is particularly versatile for adapting to the individual cases.

For example, drilling from surface in one instance may be best performed using conventional rotary drilling with a bit, drill collars and sectional tubing 310. In other instances, by making up a BHA using the rotary table 311 and coupling with coiled tubing 110, surface hole can be drilled with the coiled tubing injector 100. Typically, surface hole is drilled and cased using threaded sectional tubulars and the remainder of the drilling is conducted with coiled tubing 110.

One step-by-step example which illustrates the versatility of the dual duty hybrid drilling system is as follows.

Arrive on site, position the tubular rig 310 at the well site, and erect the dual duty mast 304. Using the integrated hydraulics, lift the mast 304, pivoting on the lower legs 355*b*. Pin the upper legs 356*a*,356*b*, locking the mast 304 over the substructure 350. The guide arch 316 is extended, clearing the portion of the mast aligned over the well 302.

Using the second drawworks 382, pick up a kelly 384 and swivel 383 (assuming a rotary table 311 and not a power swivel). Using the first drawworks 381, pickup tubulars 310, including drill pipe and collars (assuming drilling surface hole with sectional tubing).

Drill surface hole. Once drilled, run surface casing tubulars and install a wellhead/BOP 302*b*.

Set the kelly 384 aside in the mast 304 or lay the kelly down, freeing the second drawworks 382. Using the first drawworks 381, lift a preassembled BHA, or lift BHA components and use the rotary table 311 to assemble the BHA. The first drawworks 381 can be side shifted in the crown 353 to clear the mast 304 over the well 302.

If not already positioned, set the coiled tubing rig 303 with the injector 100 adjacent the well 302 and aligned to the mast 304. Using the second drawworks 382, lift the injector 100 into the mast 304 while spooling out coiled tubing 110. Land the injector 100 on the substructure 350 and couple the chair 309 and base structures 391. Set the coiled tubing 110 into the guide arch 316.

Using the rotary table, connect the BHA to the coiled tubing and commence drilling with coiled tubing 110.

At any time, as required, the second drawworks 383 are shifted and the injector 100 is set aside in the mast 304. With the injector 100 out of the way, the first drawworks 381 could be fitted with elevators or with a swivel and kelly again for handling tubulars 310.

The embodiments of the invention for which an exclusive property or privilege is claimed are defined as follows:

1. Apparatus for injecting coiled tubing into a wellbore from a source and withdrawing same, comprising:

a chain conveyor driven about an endless path and having at least one linear section aligned with the wellbore;

a multiplicity of gripper blocks conveyed and driven by the chain conveyor, the gripper blocks forming a substantially continuous coiled tubing support while traversing the linear section; and a linear array of a multiplicity of rollers in parallel and opposing arrangement to the linear section of the chain conveyor for forming a corridor between the rollers and the gripper blocks and through which the coiled tubing extends, the rollers urging the coiled tubing into frictional engagement with the gripper blocks so that as the gripper blocks are driven about the endless path they frictionally drive the coiled tubing, along, the corridor to inject or withdraw coiled tubing.

2. The apparatus of claim 1 further comprising means for supporting the gripper blocks against the normal forces produced by the linear array of rollers.

3. The apparatus of claim 2 wherein the means for supporting the linear section of the chain conveyor against normal forces comprises a continuous track positioned on the opposing side of the chain conveyor from the gripper blocks.

4. The apparatus of claim 3 wherein the means for supporting the linear section of the chain conveyor against normal forces comprises at least one pair of idlers extending laterally from each gripper block, the idlers engaging and rolling along the continuous track for supporting the chain conveyor thereabove.

5. The apparatus of claim 4 further comprising biasing means for urging the rollers into engagement with the coiled tubing.

6. The apparatus of claim 5 wherein the biasing means comprises:

a housing supporting one or more rollers rotationally therein;

a first telescoping member extending from the roller housing;

a second telescoping member secured relative to the track; and spring means between first and second telescoping members for urging the rollers into engagement with the coiled tubing.

7. The apparatus of claim 6 wherein each roller housing supports a pair of parallel rollers and further comprises a single pivot point to which the first telescoping member is pivotally connected.

8. The apparatus of claim 1 further comprising:

a head sprocket over which the chain conveyor extends; and a tail sprocket over which the chain conveyor extends so that the linear portion of the chain conveyor is formed along a line substantially tangent between the head and tail sprockets.

9. The apparatus of claim 8 further comprising one or more drives which rotate one or both of the head or tail sprockets.

10. The apparatus of claim 9 further comprising transmission means between each of the drives and the head and tail sprockets so that the drives can be located within the endless path.

11. The apparatus of claim 10 further comprising a tubing straightener positioned between the apparatus and the coiled tubing source.

12. The apparatus of claim 11 wherein the straightener is further positioned just preceding the corridor between the linear portion of the gripper blocks and the linear array of rollers.

13. The apparatus of claim 1 further comprising a continuous track positioned on the opposing side of the chain conveyor from the gripper blocks against which the gripper blocks bear upon application of normal forces produced by the linear array of rollers.

14. The apparatus of claim 13 further comprising at least one pair of idlers extending laterally from each gripper block, the idlers engaging and rolling along the continuous track for supporting the chain conveyor thereon.

15. The apparatus of claim 14 further comprising a spring assembly for urging the rollers into engagement with the coiled tubing.

16. The apparatus of claim 15 wherein the spring assembly comprises:

a housing supporting one or more rollers rotationally therein;

a first telescoping member extending from the roller housing;

a second telescoping member secured relative to the track; and springs between first and second telescoping members for urging the rollers into engagement with the coiled tubing.

17. The apparatus of claim 16 wherein each roller housing supports a pair of parallel rollers and further comprises a single pivot point to which the first telescoping member is pivotally connected.

18. The apparatus of claim 1 further comprising:

a head sprocket over which the chain conveyor extends; and a tail sprocket over which the chain conveyor extends so that the linear portion of the chain conveyor is formed along a line substantially tangent between the head and tail sprockets.

19. The apparatus of claim 18 further comprising one or more drives connected to one or both of the head or tail sprockets.

20. The apparatus of claim 18 further comprising transmission means between each of the drives and the head and tail sprockets so that the drives can be positioned within the endless path.

21. The apparatus of claim 1 further comprising a tubing straightener positioned between the apparatus and the coiled tubing source.

22. The apparatus of claim 21 wherein the straightener is positioned just preceding the corridor.

23. A method of injecting coiled tubing into a wellbore from a source and withdrawing same, comprising:

providing an injector apparatus, the apparatus having a chain conveyer extending about an endless path and having at least one linear section of a multiplicity of gripper blocks conveyed and driven by the chain conveyor and a linear array of rollers in parallel and opposing arrangement to the gripper blocks for forming a corridor aligned with the wellbore;

straightening the coiled tubing;

extending the straightened coiled tubing through the corridor;

urging the linear array of rollers into engagement with the coiled tubing;

supporting the multiplicity of gripper blocks against the normal forces produced by the linear array of rollers; and driving the chain conveyer along an endless path so as to drive the gripping blocks which frictionally drive the coiled tubing along the corridor to inject or withdraw the coiled tubing.

24. The method as described in claim 23 wherein the conveyor is fitted with a plurality of idlers and the method further comprises:

providing a continuous track; and supporting the idlers along the continuous track, which roll thereon during the driving step.

25. The method as described in claim 23 wherein in the urging step the rollers are urged into engagement with the coiled tubing by a biasing means.

26. The method as described in claim 25 wherein in the urging step the method further comprises levering the rollers into engagement with the coiled tubing using a spring.

* * * * *